US005855197A

United States Patent [19]

Kato

[11] Patent Number: 5,855,197

[45] Date of Patent: Jan. 5, 1999

[54] VAPOR SEPARATOR FOR FUEL INJECTED ENGINE

[75] Inventor: Masahiko Kato, Hamamatsu, Japan

[73] Assignee: Sanshin Kogyo Kabushiki Kaisha, Japan

[21] Appl. No.: 651,771

[22] Filed: May 22, 1996

[30] Foreign Application Priority Data

May 22, 1995 [JP] Japan ..... 7-122802

[51] Int. Cl.[6] ..... F02M 41/00

[52] U.S. Cl. ..... 123/516; 123/509

[58] Field of Search ..... 123/516, 518, 123/509; 417/423.3; 210/416.1, 416.4; 418/225

[56] References Cited

U.S. PATENT DOCUMENTS

| | | | |
|---|---|---|---|
| 4,362,480 | 12/1982 | Suzuki et al. | 418/152 |
| 4,692,105 | 9/1987 | Leroy | 418/225 |
| 5,103,793 | 4/1992 | Riese et al. | 123/516 |
| 5,146,901 | 9/1992 | Jones | 123/516 |
| 5,309,885 | 5/1994 | Rawlings et al. | 123/509 |
| 5,363,827 | 11/1994 | Siekmann | 123/509 |
| 5,368,001 | 11/1994 | Roche | 123/516 |
| 5,375,578 | 12/1994 | Kato et al. | 123/516 |
| 5,378,111 | 1/1995 | Christopher | 417/203 |
| 5,389,245 | 2/1995 | Jaeger et al. | 123/516 |
| 5,393,206 | 2/1995 | Roth et al. | 417/313 |
| 5,404,858 | 4/1995 | Kato | 123/516 |
| 5,482,021 | 1/1996 | Roche | 123/509 |

OTHER PUBLICATIONS

Carter Fuel Pumps and Fuel Pump Assemblies Catalogue #3879, 1994, Weatherly Index No. 604, p. 214.

*Primary Examiner*—Thomas N. Moulis

*Attorney, Agent, or Firm*—Knobbe, Martens, Olson & Bear, LLP

[57] ABSTRACT

A compact vapor separator for a fuel injection system reduces the size of the fuel system mounted on the side of an outboard engine. The girth of the outboard motor's power head consequently is decreased. In one embodiment, the vapor separator employs a plurality of rotary vane-type pumps. The pumps are sized to produce a sufficient flow rate and fuel pressure, while minimizing power consumption. At least one of the fuel pumps can be located on a periphery of a housing of the vapor separator and can be removably attached thereto to facilitate easy removal and assembly for service and repair. The vapor separator also can include a redundant seal arrangement to generally isolate an exterior casing of the fuel pump from the fuel and to seal an upper end of the housing. In another embodiment, a dividing wall separates the fuel pump from an fuel supply inlet of the fuel tank. The wall inhibits gas bubble migration toward the inlet of the fuel pump. The fuel pump thus draws less vapor.

46 Claims, 15 Drawing Sheets

VAPOR SEPARATOR FOR FUEL INJECTED ENGINE

BACKGROUND OF THE INVENTION

1. Field of the Invention

The present invention relates in general to an internal combustion engine, and more particularly to a fuel injection system of an internal combustion engine.

2. Description of Related Art

Several outboard motors recently have become equipped with fuel injection systems in response to increased concerns regarding hydrocarbon emissions. Such systems, which are monitored and controlled by an electronic control unit, significantly reduce hydrocarbon emissions, while improving fuel economy and performance.

Fuel injection system typically include a vapor separator and a high-pressure pump. The pump delivers pressurized fuel to the individual fuel injectors. An engine typically includes one, and sometimes two fuel injectors per cylinder. The pump must be of a sufficient size to supply fuel to the injectors at a desired pressure, while producing a significant flow rate through a fuel recirculation branch of the fuel delivery system to reduce the temperature of the fuel at the inlet to the fuel injector. Prior fuel delivery systems thus have included a large centrifugal type (e.g. Wesco-type) fuel pump in order to meet these needs.

Large-size pumps, however, generally increase the size of the engine, and thus the size of the power head. The power head of an outboard motor generally extends above the transom of the watercraft and, consequently, the power head produces aerodynamic drag on the watercraft as the watercraft speeds over the water. The size and shape of the power head directly affect the amount of drag produced. A large-size pump thus negatively increases the drag experienced by the outboard motor.

Many outboard motors which employ fuel injection system use an integrated vapor separator/fuel pump assembly. That is, a single housing encloses the fuel tank of the vapor separator and the fuel pump. The fuel pump draws fuel directly from the fuel tank. Although this design somewhat reduces the size of these components, the integrated design makes it difficult to service or repair the pump. A service technician must remove the entire housing and then disassemble the housing in order to gain access to the pump. This act commonly destroys the housing seal. The technician must then disconnect and remove the pump from the housing. After servicing, the technician reassembles the unit in the reverse manner, replacing the housing seal. These steps overly complicate the assembly and service procedures, and add cost to the service and maintenance of the outboard motor.

Another drawback of prior unitary vapor separator/fuel pump assemblies resides with the position of the pump inlet relative to the fuel tank of the vapor separator. Fuel vapor and air are separated from liquid fuel in the fuel tank of the vapor separator. The influent port to the fuel pump, which also commonly is located in the fuel tank, tends to draw in gas bubbles before the bubbles surface in the fuel tank of the vapor separator, especially where the pump influent port lies near the point where the fuel enters the tank through the supply inlet port. Vapor bubbles in the fuel line significantly alters the fuel ratio of the fuel/air charge delivered to the cylinder combustion chambers. Inefficiencies and rough running of the engine result from this effect. In addition, in some fuel delivery systems, the bubbles can produce a vapor-lock and prevent fuel flow through the high-pressure portion of the fuel delivery system.

SUMMARY OF THE INVENTION

A need therefore exists for a compact, sealed vapor separator which facilitates convenient removal and assembly of the fuel pump for service and repair. The fuel pump of the vapor separator desirably meets the desired fuel flow and pressure design criteria and is arranged in the vapor separator assembly to inhibit the intake of vapor bubbles into the high-pressure fuel circuit of the fuel delivery system.

One aspect of the present invention involves a vapor separator assembly for a fuel delivery system used with an internal combustion engine. The vapor separator assembly comprises a housing that defines an internal fuel tank enclosed within the housing. A plurality of fuel pump are supported within the housing. Each fuel pump communicates with the fuel tank and with a return inlet port that flows into the fuel tank.

In one embodiment, the fuel pumps are centrifugal, rotary-vane type fuel pumps. The pumps are sized so as to together produce a sufficient flow rate and fuel pressure. Two small fuel pumps thus can replace one large fuel pump. With centrifugal, rotary-vane type fuel pumps (e.g., Wesco-type fuel pumps), the pumps can be downsized to one-fourth of the size of the convention single fuel pump. As a result, the fuel pump system can be downsized to one-half of the conventional size, thereby reducing the size of the vapor separator assembly. Two small pumps also consume less power than a single large conventional rotary-vane type fuel pump.

In accordance with another aspect of the present invention, a vapor separator assembly is provided for a fuel delivery system used with an internal combustion engine. The vapor separator assembly comprises a housing defining an internal fuel tank which is enclosed within the housing. A fuel pump is supported within the housing. The fuel pump is a roller-vane type fuel pump and communicates with the fuel tank.

Another aspect of the present invention involves a vapor separator assembly for a fuel delivery system used with an internal combustion engine. The vapor separator assembly includes a housing that defines an internal fuel tank. The fuel tank is enclosed within the housing. At least one fuel pump is supported by the housing with a portion of the pump being exposed outside the housing. A releasable coupling interconnects the pump and the housing to place the pump in communication with the fuel tank.

An additional aspect of the present invention involves a vapor separator assembly for a fuel delivery system used with an internal combustion engine. The vapor separator assembly comprises first and second fuel tanks which communicate with one another. A fuel inlet communicates with the first fuel tank, and at least one fuel pump communicates with the second fuel tank.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
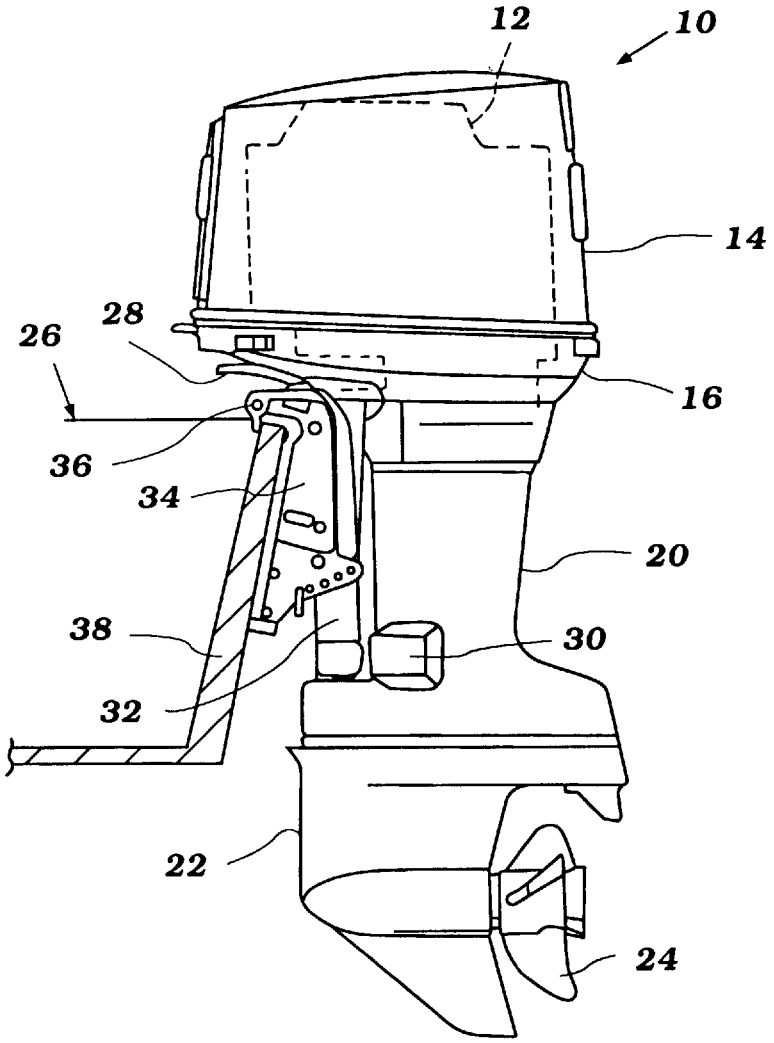
FIG. 1 is a side elevational view of an outboard motor on which the present vapor separator can be employed.

FIG. 1 illustrates an outboard drive 10 which incorporates a fuel separator configured in accordance with the present invention. Because the present vapor separator has particular utility with an outboard motor, the vapor separator is described below in connection with an outboard motor 10; however, the depiction of the invention in conjunction with an outboard motor is merely exemplary. Those skilled in the art will readily appreciate that the present vapor separator can be used with an inboard motor of an inboard/outboard drive, to an inboard motor of a personal watercraft, and to other types of watercraft engines as well.

The outboard motor 10 includes a power head that comprises a powering internal combustion engine 12 and a surrounding protective cowling. The cowling includes a main cowling portion 14 that is detachably connected to a tray portion 16.

Figure 2:
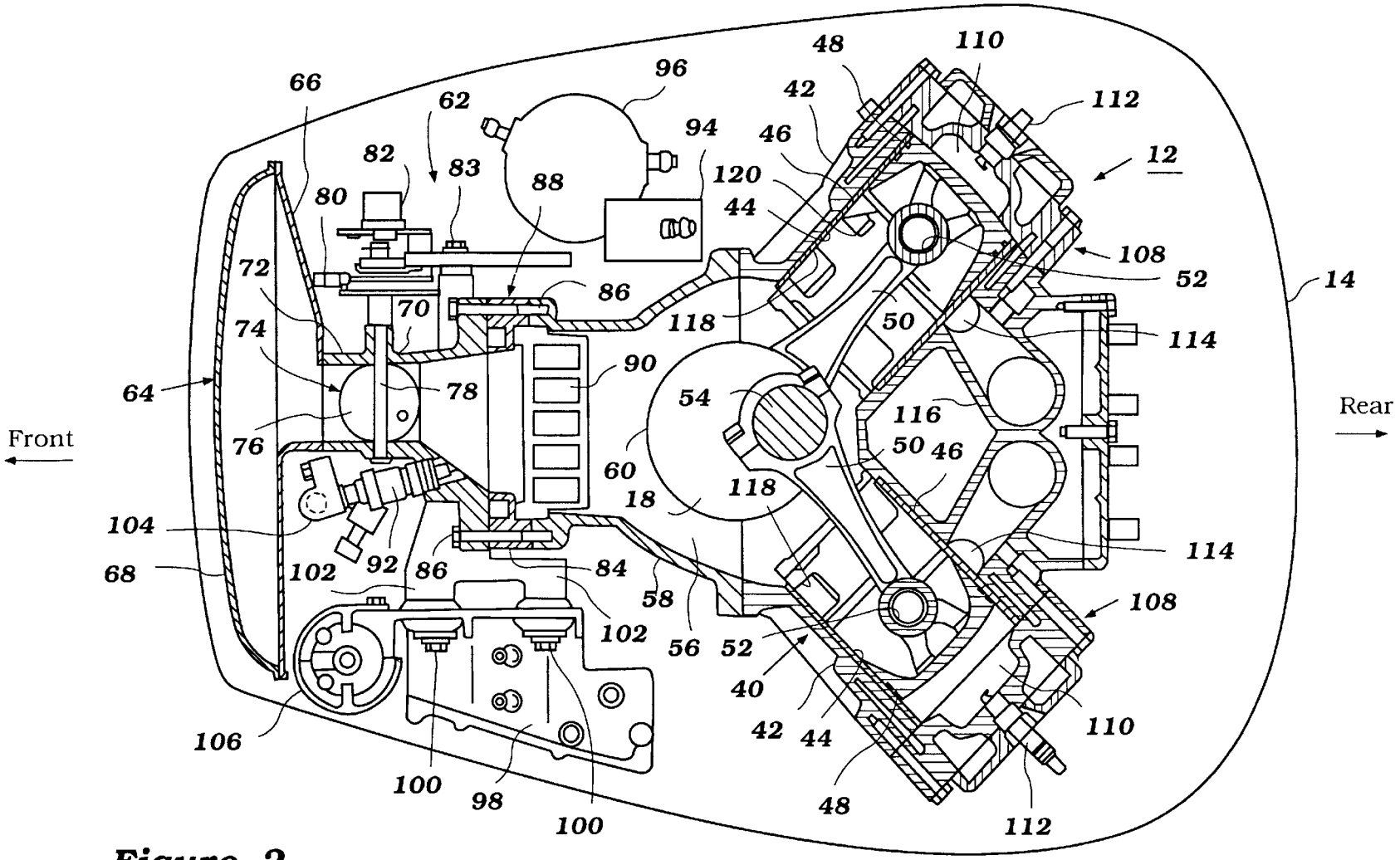
FIG. 2 is a plan, cross-sectional view of an engine of the outboard motor of FIG. 1, illustrating the location of the vapor separator on the engine.

As is typical with outboard motor practice, the engine 12 is supported within the power head so that its output shaft, a crankshaft indicated by the reference numeral 18 in FIG. 2, rotates about a vertically extending axis. This output shaft or crankshaft 18 is rotatably coupled to a drive shaft (not shown) that depends into and is journaled within a drive shaft housing 20. The tray 16 encircles the upper portion of the drive shaft housing 20.

The drive shaft continues into a lower unit 22 where it can selectively be coupled to a propeller 24 for driving the propeller 24 in selected forward or reverse direction so as to so propel an associated load, namely, a watercraft 26. A conventional forward-reverse bevel gear transmission (not shown) is provided for this purpose between the drive shaft and a propeller shaft. The propeller shaft drives the propeller in a known suitable manner.

A steering shaft (not shown) having a tiller 28 affixed to its upper end is attached by means which include a lower bracket assembly 30 to the drive shaft housing 20. This steering shaft is journaled within a swivel bracket 32 for steering of the outboard motor 10 about a vertically extending axis defined by the steering shaft.

The swivel bracket 32 is, in turn, connected to a clamping bracket 34 by a trim pin 36. This pivotal connection permits tilt and trim motion of the outboard motor 10 relative to the associated transom 38 of the watercraft 26 to which the clamping bracket 34 is mounted.

The construction of the outboard motor 10 as thus far described may be considered to be conventional, and for that reason further details of this construction are not believed necessary to permit those skilled in the art to practice the invention.

In order to facilitate the description of the present invention, the terms "front" and "rear" are used to indicate the relative sides of the components of the engine and the vapor separator. As used herein, "front" refers to that side closes to the transom 38 of the watercraft 26, while "rear" refers to that side away from the transom 38. FIG. 2 includes similar labels to further aid the reader's understanding.

With reference to FIG. 2, the engine 12 is, in the illustrated embodiment, a reciprocating multi-cylinder engine operating on a two-cycle crankcase compression principle. The engine 12 has a V-type configuration, though it will be readily apparent to those skilled in the art how the invention may be utilized with engines having other cylinder arrangements, such as, for example, in-line or slant cylinder arrangements, and operate on other than a two-cycle crankcase compression principle, such as, for example, a four-cycle principle.

The engine 12 is provided with a cylinder block assembly 40 that lies generally within the center of the power head. The cylinder block 40 includes a pair of inclined cylinder banks 42 which extend at an angle relative to each other to give the engine a conventional V-type configuration.

Each cylinder bank 42 includes a plurality of parallel cylinder bores 44 that are formed by cylinder liners 46. Each cylinder liner 46 is cast or pressed in place in a cylinder bank 42. Pistons 48 reciprocate within the bores 44 and are rotatably journaled about the small ends of connecting rods 50 by means of piston pins 52. The big ends of the connecting rods 50 in turn are journaled about throws 54 of the crankshaft 18.

As is typical with V-type engine arrangements, the cylinder bores 44 of the first cylinder bank 42 are offset slightly in the vertical direction from the cylinder bores 44 of the second cylinder bank 42 so that the connecting rods 50 of adjacent cylinder bores 44 can be journaled on the same throw 54 of the crankshaft 18, as shown in FIG. 2.

The crankshaft 18 is rotatably journaled within a crankcase chamber 56, formed at the lower ends of the cylinder bores 44. The crankcase chambers 56 are formed by the skirt of the cylinder block 40 and a crankcase member 58 that is affixed to the cylinder block 40 in any well-known manner. As has been noted, the engine 12 operates on a two-cycle crankcase compression principle. As is typical with such engines, the crankcase chambers 56 associated with each of the cylinder bores 44 are sealed relative to each other in a manner which includes the utilization of sealing disks 60 provided on the crankshaft 18. These disks 60 are disposed on the throws 54 of the crankshaft 18 and separate the big ends of adjacent connecting rods 50.

A supply of atmospheric air is delivered to the crankcase chambers 56 by an induction system that is indicated generally by the reference numeral 62. The induction system 62 is composed of a plenum chamber 64 that includes forward and rearward portions 66 and 68, respectively, that are affixed to each other by any suitable means. The plenum chamber 64 receives a supply of atmospheric air through an opening (not shown) formed in the main cowling portion 14 of the power head. This air is then delivered to a number of adjacent throttle body assemblies 70, of which in FIG. 2 a single assembly is shown and associated with the adjacent cylinder bores 44 illustrated.

The throttle body assembly 70 is composed of a housing 72 in which is positioned a butterfly-type throttle valve assembly 74 for regulating the air flow through the throttle body 70. The throttle valve assembly 74 includes a valve 76 that is affixed to a shaft 78 which is, in turn, rotatably journaled within the housing 72 and affixed at one end to a manually operated throttle control 80. The throttle control 80 is provided with a throttle position sensor 82 which signals an electronic control unit ECU (not shown). The throttle control 80 is affixed to the throttle housing 70 by a bolt 83.

At its end opposite the plenum chamber 64, the throttle body 70 is affixed to an intake housing 84 by means of bolts 86 which extend through the housing 84 and into the end of the crankcase member 58 opposite of the cylinder block 40. Thus, the throttle body housing 70, intake housing 84, and forward end of the crankcase member 58 together comprise an intake passage 88 which delivers atmospheric air to the crankcase chamber 56.

A reed-type check valve 90 is disposed within the intake passage 88 at the junction between the intake housing 84 and the crankcase member 58 and operates to preclude reverse air flow in a known manner.

Fuel is supplied to the air charge admitted, as thus far described, by a fuel injector that is indicated by the reference numeral 92 and mounted within the throttle body housing 72 downstream of the throttle valve 74. The fuel injector 92 receives a supply of fuel from a fuel delivery system which is composed of a fuel tank (not shown) that is mounted within the hull of the associated watercraft 26 and delivers fuel to a low-pressure fuel pump 94 positioned along the side of the engine 12, as seen in FIG. 2, through a conduit (not shown).

A fuel filter 96 is positioned adjacent to the low-pressure fuel pump 94 and receives fuel from the fuel tank as the pump 94 draws the fuel through a conduit (not shown). The fuel filter 96 separates water and other contaminants from the fuel. From the fuel filter 96 and fuel pump 94, the fuel enters an additional conduit (not shown) which traverses the engine 12 and opens to a vapor separator assembly 98. The vapor separator separates fuel vapor and other gases from the liquid fuel, and will be discussed in detail below. Bolts 100 secure the vapor separator 98 to a mounting bracket 102, which in turn is affixed to the side of the throttle housing 72 adjacent to the fuel injector 92 by any suitable means. In the illustrated embodiment, the vapor separator 98 lies on a side of the induction system 62 opposite of the side on which the low-pressure pump 94 is located.

Fuel is pumped from the vapor separator 98 through a conduit (not shown) to the lower end of a vertically extending fuel rail 104 by a high-pressure pump 106. The high-pressure pump 106 forms a portion of the vapor separator assembly 98. The fuel rail 104 delivers fuel to each of the fuel injectors 92. For this purpose the fuel rail 104 communicates with a plurality of supply ports (not shown) provided along the length of the fuel rail 104, each of which communicates with a fuel injector to supply the fuel injector 92 with fuel.

A fuel return line (not shown) extends between an outlet port of the fuel rail 104 and the vapor separator 98. The return line completes a fuel flow loop that generally maintains a constant flow of fuel through the fuel rail 104. This constant fuel flow inhibits heat transfer to the fuel, and thus reduces fuel vaporization within the fuel rail 104. The vertical orientation of the fuel rail 104 also facilitates separation of any fuel vapor which occurs downstream of the vapor separator 98 from the fuel flow into the fuel injectors 92.

A pressure regulator (not shown) desirably lies within the above fuel flow loop and maintains a uniform fuel pressure at the injectors 92, e.g., 50–100 atm. The regulator regulates the fuel pressure by dumping excess fuel back to the vapor separator 98, as is well known in the art.

A pair of cylinder head assemblies 108 are affixed in closing relation to the ends of the cylinder bores 44 opposite to the ends that open to the crankcase chamber 56 by any suitable means. The cylinder heads 108 define a recess which operates with the bores 44 and heads of the pistons 48 to form combustion chambers 110, whose volume varies cyclicly with the motion of the pistons 48. A spark plug 112 is mounted atop each of the cylinder heads 108 and has its gap extending into the combustion chamber 110. The spark plugs 112 are fired by an ignition control circuit (not shown) that is controlled by the ECU. The open upper ends of the cylinder heads 108 are sealed by covers 113 that are affixed to the cylinder heads 108 by any suitable means.

Exhaust passages 114 are formed along each cylinder bank 42 along the sides which face the opposite cylinder bank 44. The exhaust passages 114 open to the cylinder bores 44 at a position that is approximately half way along the longitudinal bore 44. The exhaust passages 114 of opposite cylinder banks 42 extend towards each other and merge to form an exhaust manifold 116, which routes exhaust gases through an exhaust system (not shown) for purification before being expelled from the outboard motor 10.

One or more scavenge passages (not shown) are formed within each cylinder bank 42. Each passage includes an inlet port 118 which is disposed in the lower end of the bore 44 and opens to the crankcase chamber 56, and an outlet port 120 which is disposed at a longitudinal position along the bores 44 that is slightly below and on the opposite side of the exhaust passage 114 and opens to each of the bores 44.

The above-described engine 12 operates in the following manner. Upward motion of the piston 48 draws atmospheric air and injected fuel from the fuel injector 92 through the induction passage 88 and into the crankcase chamber 56, past the reed valve 90. The reed valve 90 is open at this point, because the pressure in the induction passage 88 is greater than the pressure in the crankcase chamber 56.

Sometime after the piston 48 passes top dead center (TDC), the pressure in the crankcase chamber 56 will exceed the induction passage pressure, and the reed valve 90 will close. The air-fuel mixture in the crankcase chamber 56 is then compressed by the piston 48 during its downstroke until the outlet port 120 of the scavenge passage is exposed to the combustion chamber 110. At this point the compressed air-fuel mixture enters the combustion chamber 110 through the scavenge passage and is further compressed by the ensuing compression stroke of the piston 48.

At some point before top dead center (TDC), the spark plug 112 is fired by the ECU, and the air-fuel mixture ignites, burns, and expands. This forces the piston 48 downwardly, and thus drives the crankshaft 18. Continued downward motion of the piston 48 exposes the exhaust passage 114 to the combustion chamber 110, and thus permits the combustion gases to be expelled from the combustion chamber 110 through the exhaust passage 114.

Before describing the present fuel vapor separator 98 in detail, a conventional vapor separator will first be described in order for the reader to appreciate the advantages of the present vapor separator 98. Because many of the components of the present vapor separator and the conventional vapor separator will be the same or substantially similar, like reference numerals will be used to indicate similar components between the conventional vapor separator and the present vapor separator. An "a" suffix will be later added to the similar components of the present vapor separator in order to distinguish the two designs.

Figure 3:
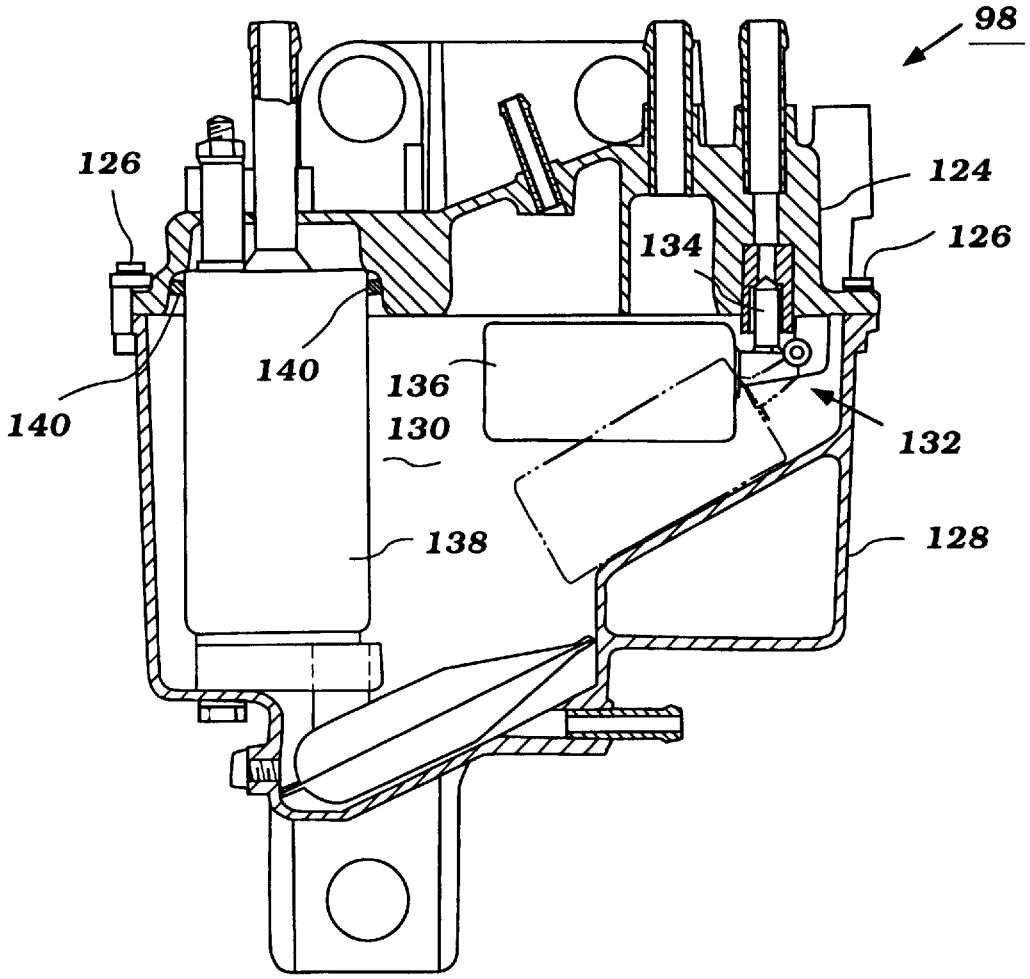
Figure 3 Prior Art
FIG. 3 is a side, cross-sectional view of a conventional vapor separator.

A conventional fuel vapor separator will now be discussed in detail. FIG. 3 illustrates the conventional vapor separator which as previously stated separates fuel vapor and other gases from the liquid fuel supply to the injectors 92. The vapor separator includes a cover 124 that is affixed by bolts 126 to a bowl 128. The cover 124 and bowl 128 form a large housing. The housing generally defines a fully enclosed fuel tank or internal cavity 130. Fuel is supplied from the low pressure fuel pump 94 to the fuel tank 130 past a metering system 132 which includes a needle valve 134 and float 136 for controlling the fuel flow into the fuel tank 130.

A high pressure, centrifugal, rotary-vane type pump 138 (e.g., a Wesco-type fuel pump) is submerged within the fuel tank 130 and pumps fuel to the fuel rail 104. The Wesco-type fuel pump 138 is an impeller type rotary-vane pump. Such prior pumps often are large in physical size in order to produce a desired fuel flow rate and fuel pressure due to inefficiencies in this type of pump. The shortcomings of the conventional large, centrifugal-type pump will be described in further detail below.

An O-ring seal 140 sealingly engages the upper end of the fuel pump 138. The seal 140 is pressed against the lower surface of the cover 124 so as to prevent fuel from leaking out of the fuel tank 130 past the fuel pump 138.

A number of additional problems exist with the above-described conventional vapor separator. For instance, while the seal 140 generally inhibit fuel from leaking past the high-pressure fuel pump 138 and through the cover 124, it is still possible that the fuel may leak out of the vapor separator 98 at the junction between the cover 124 and bowl 128. This is especially possible in those circumstances where the outboard motor 10 is tilted to an out-of-the-water condition (i.e., full tilt-up position) where the level of the fuel can be above the junction of the cover 124 and bowl 128. An embodiment of this invention described below precludes this possibility by isolating the high pressure fuel pump 138 from the fuel in the cavity 130.

Figure 4:
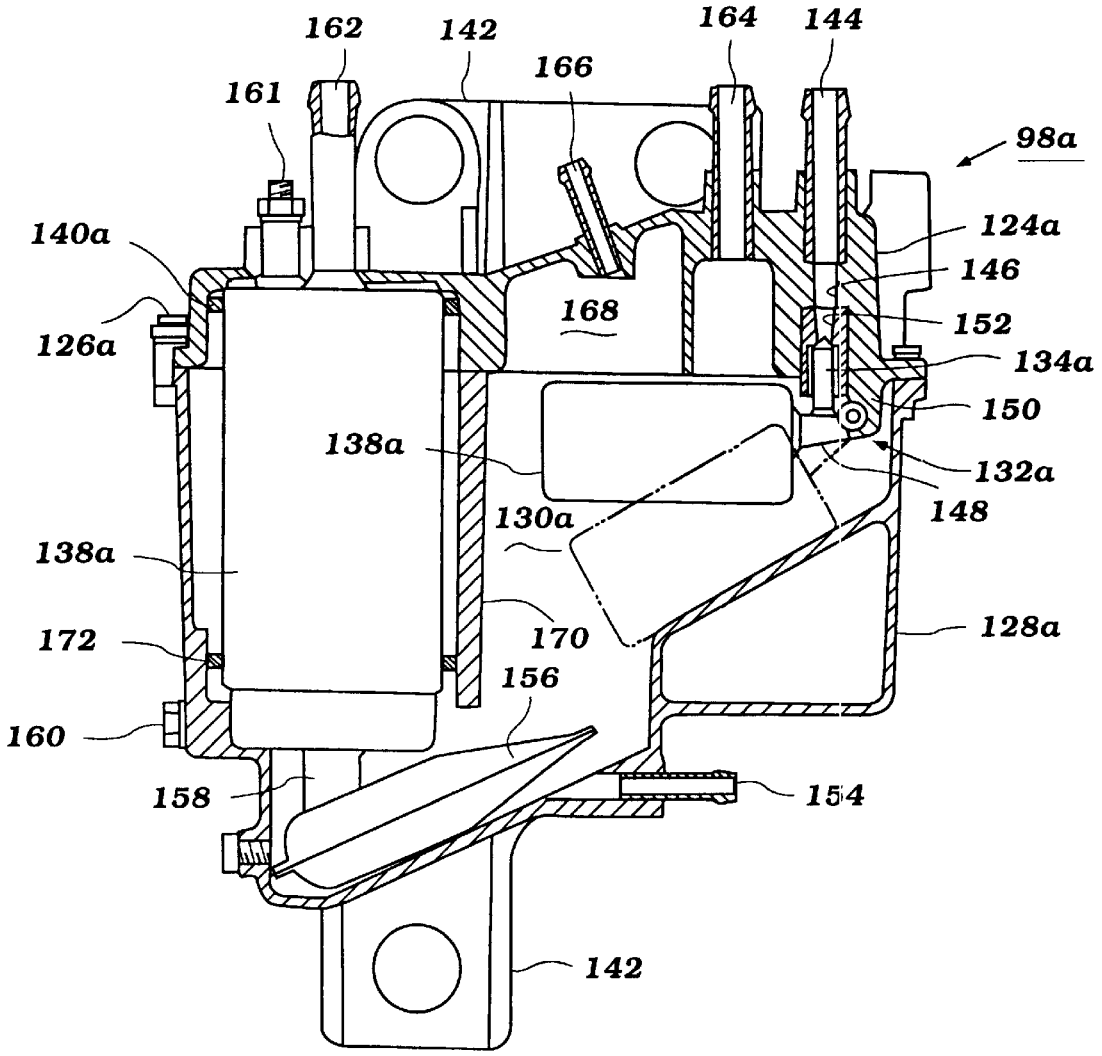
FIG. 4 is a side, cross-sectional view of the vapor separator which is configured in accordance with a preferred embodiment of the present invention.
Figure 5:
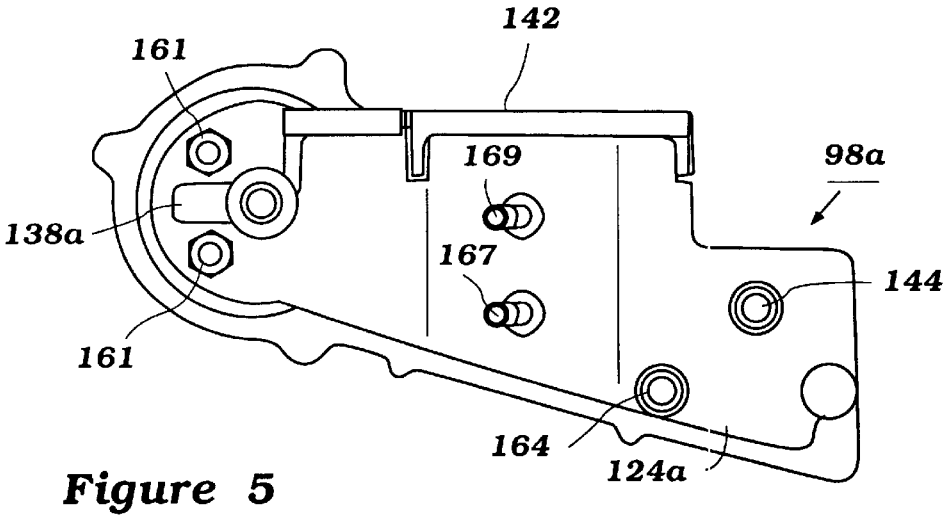
FIG. 5 is a top plan view of the vapor separator of FIG. 4.

With reference now to FIGS. 4 and 5, a vapor separator assembly 98*a* is constructed in accordance with an embodiment of the invention. The vapor separator 98*a* includes a cover 124*a* that is affixed by bolts 126*a* to the open upper end of the bowl 128*a*. The bowl 128*a* has a mounting plate portion 142 formed integrally along its inward wall as seen in FIG. 4 which serves as the means by which the vapor separator assembly 98*a* is affixed to the mounting bracket 102*a*. The cover 124*a* and the bowl 128*a* together define the fuel tank or internal cavity 130*a* which receives a supply of fuel through a conduit from the low pressure fuel pump 94.

The conduit sealingly engages a fuel supply inlet port 144 which is integrally formed within the cover 128*a* and communicates with a fuel inlet passage 146. The fuel inlet passage 146 opens to the internal cavity 130*a* and thus allows for the filling of the bowl 128*a* with fuel.

The level of fuel within the cavity 130*a* is controlled by the float-type metering system 132*a* disposed within the cavity 130*a*. The metering system 132*a* includes the float 136*a* that is rigidly affixed to the pivot arm 148 which is, in turn, pivotally connected to the bottom surface of the cover 124*a* by a bracket 150. The needle valve 134*a* is disposed atop the pivot arm 148 and extends upwardly towards a constricted portion 152 (i.e., valve seat) of the fuel inlet passage 146.

The above-described fuel metering system 132*a* functions in the following manner. As fuel is pumped into the cavity 130*a* by the low-pressure fuel pump 94 the level of the fuel within the bowl 128*a* rises. This causes the float 136*a* to rise which, in turn, causes the needle valve 134*a* to extend further upward towards the constricted portion 152 of the fuel inlet passage 146. Once the fuel in the bowl 128*a* is at a predetermined desired level the needle valve 134*a* will be disposed within the passage 146 so as to impinge against the constricted portion 152 to prevent any further fuel flow into the bowl 128*a*. When the fuel level drops the needle 134*a* no longer contacts the constricted portion 152 and fuel flows past the needle valve 134*a* into the cavity 130*a*.

An oil inlet port 154 is integrally formed within the bottom of the bowl 128*a*. The oil inlet port 154 opens to the cavity 130*a* and sealingly engages the oil conduit for providing a supply of oil from the oil tank to the vapor separator 98*a*.

A strainer 156 is disposed at the bottom of the bowl 128*a* adjacent to the oil inlet fitting 154 and draws fuel and oil from the cavity 130*a*. The bottom surface of the bowl 128*a* against which the strainer 156 lies slopes downwardly in the forward direction and thus disposes the strainer 156 within the bowl 128*a* at some angle from horizontal. The strainer 156 strains any remaining impurities from both the oil and the fuel and supplies an influent port 158 of the high pressure fuel pump 138*a*.

An electric fuel pump 138*a* draws fuel from the fuel tank 130*a*. In the illustrated embodiment, the fuel pump 138*a* desirably is of a roller-vane type configuration and utilizes sliding rollers as the rotary means by which the fuel and oil is pumped. In other words, the roller-vane type pump 138*a* is a positive displacement pump (i.e., each pump rotation moves a specific amount of fuel). Small rollers and an offset mounted rotor disc produce fuel pressure. When the rotor disc and rollers spin, they pull fuel in on one side. Then the fuel is trapped and pushed to a smaller area on the opposite side of the pump housing. This compresses the fuel between the rollers, and the fuel flows under pressure.

In the alternative, a sliding vane type fuel pump can be used. The sliding vane fuel pump function much in the same manner as the roller vane fuel pump, but sliding vanes (i.e., blades) are used instead of rollers. Both of these types of fuel pump are very efficient, but are somewhat large in size.

As seen in FIG. 3, the fuel pump 138*a* has an external casing and is disposed within the cavity 130*a*. The fuel pump 138*a* is affixed at its lower end to the bowl 128*a* by a bolt 160. The upper end of the fuel pump 138*a* is sealingly engaged by the O-ring seal 140*a* which is pressed against the lower surface of the cover plate 124*a* to provide a leak-proof seal thereto and prevents fuel and oil exiting the chamber 130*a* past the fuel pump 138*a*.

A pair of electrical terminals 161 are positioned at the upper end of the fuel pump 138*a*. The terminals 161 extend upward through the cover 124*a* and are coupled to electrical wires leading from an electrical source (e.g., a battery or generator) to supply electrical power to the rotary motor of the fuel pump 138*a*.

A fuel pump discharge port 162 is also positioned at the upper end of the fuel pump 138*a* adjacent to the terminals 161 and extends upwards through the cover plate 124*a*. The discharge port 162 sealingly engages a conduit through which fuel is pumped by the high pressure fuel pump 138*a* to the fuel rail 104.

A fuel return inlet port 164 is integrally formed within the cover 124*a* adjacent to the fuel inlet port 144 and opens to the cavity 130*a*. The fuel return inlet port 164 is sealingly engaged by the fuel return line that extends between the fuel rail 104 and the vapor separator 98*a* and returns excess fuel regulated by the pressure regulator to the cavity 130*a*.

A vapor vent port 166 is integrally formed within the cover 124*a* adjacent to the return inlet port 164 and opens to the uppermost portion of the cavity 130*a* which is henceforth referred to as the vapor cavity and indicated by the reference numeral 168. A vent conduit (not shown) sealingly engages the vapor vent port 166 and terminates at the induction system for the engine 12. Fuel vapors and other gases from the fuel in the bowl 128*a* will rise into the vapor cavity 168 and be routed to the induction system in a conventional manner.

An oil return port 169 is disposed within the cover 124*a* in side-by-side relationship with the vapor vent port 166 and returns oil from the engine 12 through a conduit (not shown) to the vapor separator assembly 98*a*.

An internal dividing wall 170 extends within the bowl 128*a* and separates the high-pressure fuel pump 138*a* from the cavity 130*a*. A further O-ring seal 172 sealingly engages the lower end of the fuel pump 138*a* and is pressed against the rearward surface of the bowl 128*a* and the wall 170 so as to provide a redundant, generally leak-proof seal which maintains separation between the fuel and oil in the chamber 130*a* and all but the lower portion of the fuel pump 138*a*.

The lower end of the fuel pump 138*a* is affixed to the bowl 128*a* by the screw 160 that extends horizontally through the bowl 128*a* because the bowl mounting surface for the fuel pump lower surface is minimized so as to allow the influent port 158 to be centrally positioned on the underside of the high pressure fuel pump 138*a*.

The vapor separator 98*a* described above precludes fuel from leaking past the junction between the cover 124*a* and the bowl 128*a* because the seal 172 prevents the fuel and oil in the cavity 130*a* from approaching the junction, even when the outboard motor 10 is in a fully trimmed-down position. The above vapor separator 98*a* offers a further advantage in that the wall 170 reduces the likelihood of air bubbles or vapor entering the fuel pump 138*a*, which results in the high pressure fuel pump 138*a* drawing in less air and vapor. Also, the proximity of the fuel in the bowl 128*a* to the fuel pump 138*a* reduces the noise emissions from and cools the fuel pump 138*a*. The cooling of the fuel pump does heat the fuel in the bowl 128*a*, but not sufficiently high so as to cause fuel vaporization to occur.

In the following embodiments, many of the components of the vapor separator will be similar to those described above. Accordingly, the following description will use the same reference numeral to indicate like components between the embodiments, but with each embodiment using a different suffix letter. It is intended that unless indicated otherwise, the first description of a component will apply equally to similar components in all subsequently embodiments for brevity.

Figure 6:
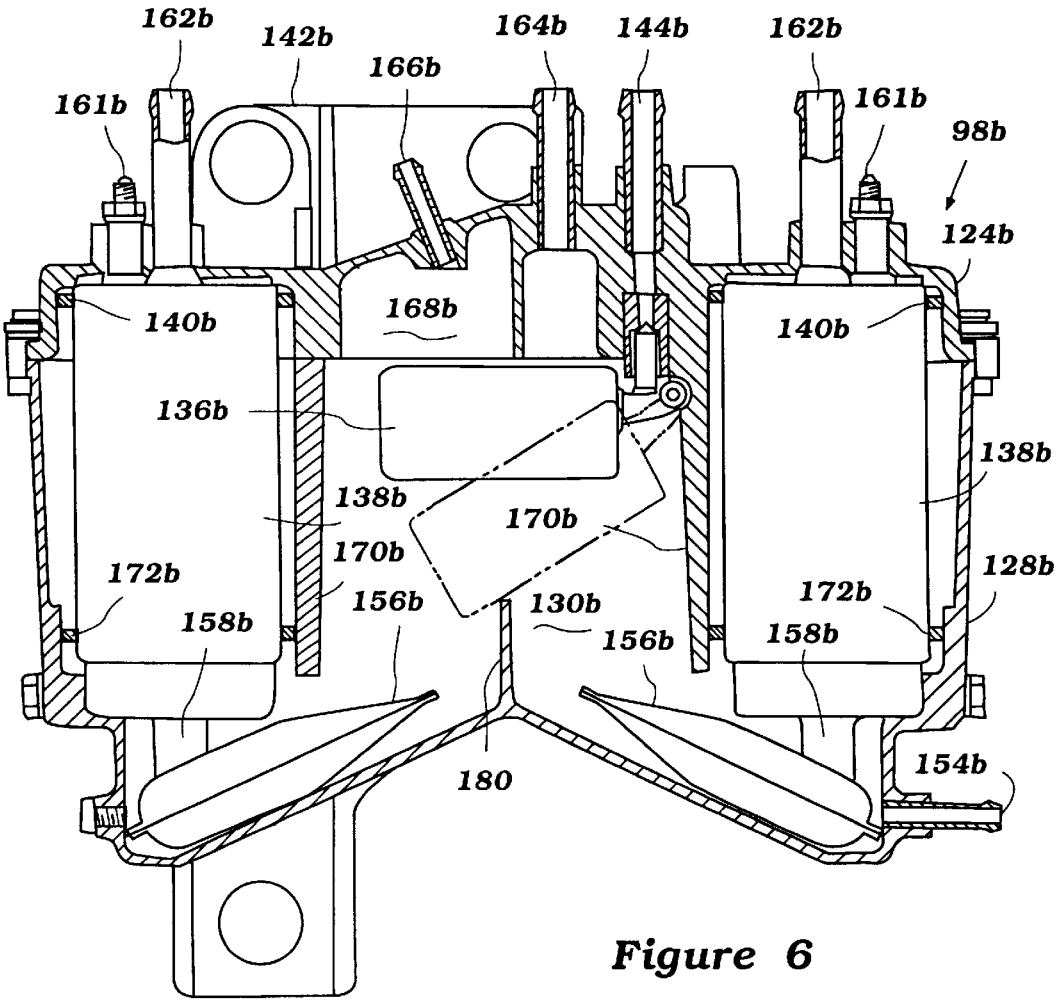
FIG. 6 is a side, cross-sectional view of the vapor separator which is configured in accordance with another preferred embodiment of the present invention.
Figure 7:
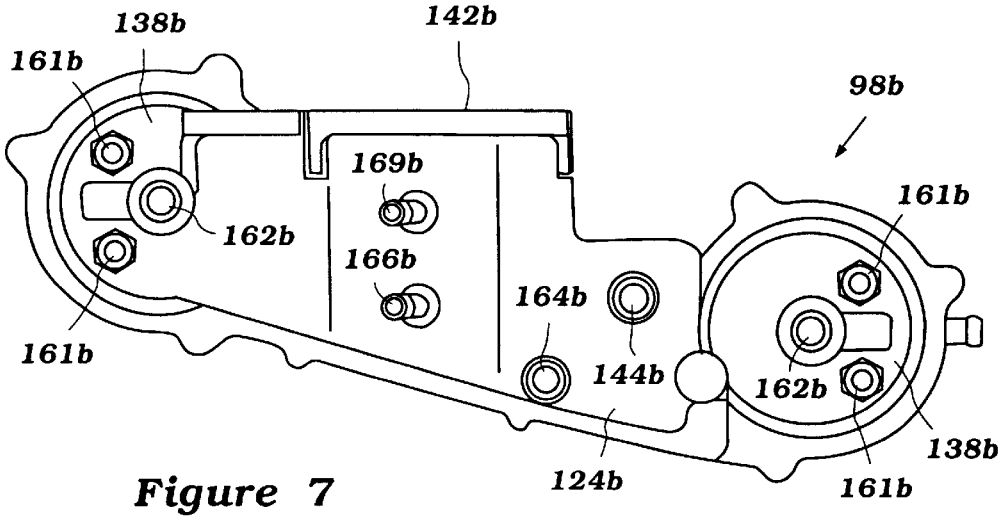
FIG. 7 is a top plan view of the vapor separator of FIG. 6.

FIGS. 6 and 7 illustrate another vapor separator 98*b* that is identical to the vapor separator 98*a* of FIGS. 4 and 5 but with a second strainer 156*b* and high pressure fuel pump 138*b* added. The second fuel pump 138*b* is also a roller-vane type pump and is disposed within the rearward portion of the bowl 128*b* and separated and sealed from the cavity 130*b* by a further internal wall 170*b* and O-ring seal 172*b*. The single oil inlet port 154*b* is disposed at the rearward lower end of the bowl 128*b* adjacent to the second strainer 156*b* while a wall 180 extends upwardly between the strainers 156*b* and terminates within the cavity 130*b* below the float 136*b*.

The above-described vapor separator 98*b* offers the same advantages as the previous embodiments because both of the fuel pumps 138*b* are isolated from the cavity 130*b* by the seals 172*b* and the walls 170*b* reduce the likelihood of air and fuel vapor entering either of the fuel pumps 138*b*. Of course, the above configuration also provides for greater fuel recirculation which results in cooler fuel flow within the fuel rail 104 and thus reduces the likelihood of vapors forming within the fuel rail 104.

Because the available space within the power head of the outboard motor 10 is limited it is highly desirable to provide a vapor separator assembly which is compact in design and therefore more readily packaged within the space available. A further embodiment of this invention addresses this by providing a physically compact configuration for the vapor separator which may be more easily accommodated within the power head of the outboard motor 10.

Figure 8:
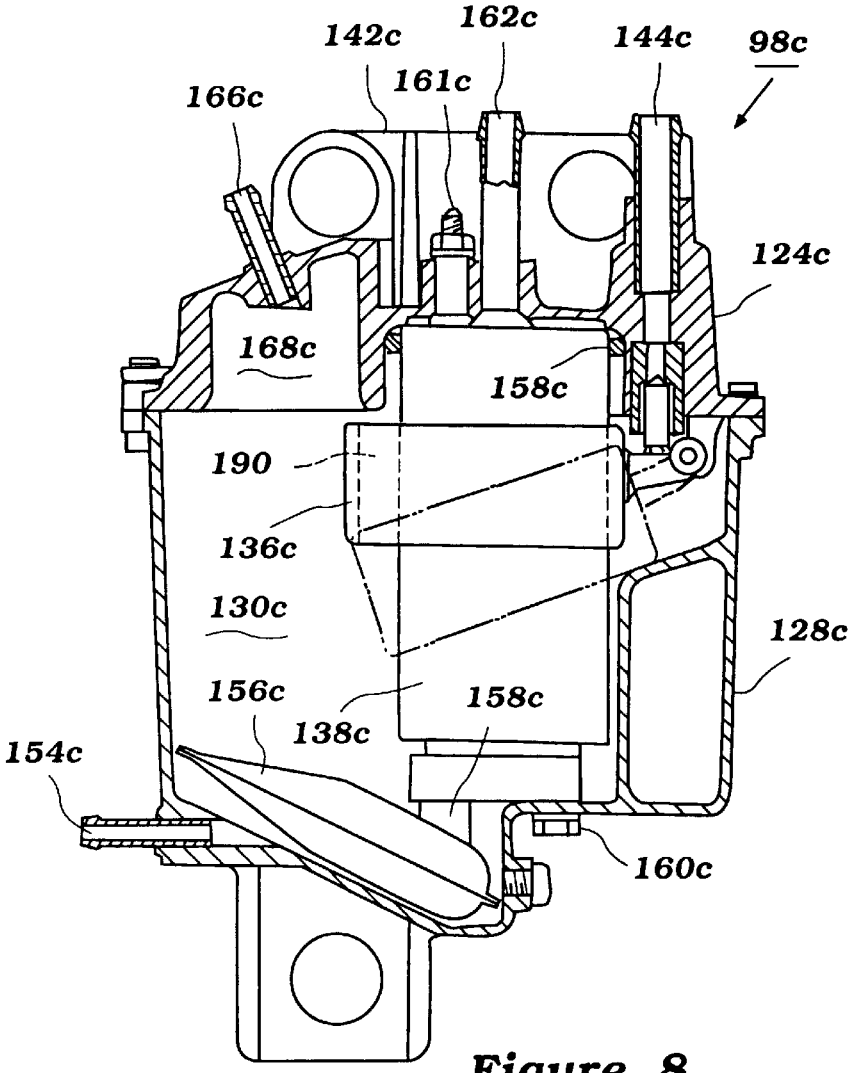
FIG. 8 is a side, cross-sectional view of the vapor separator which is configured in accordance with an additional preferred embodiment of the present invention.
Figure 9:
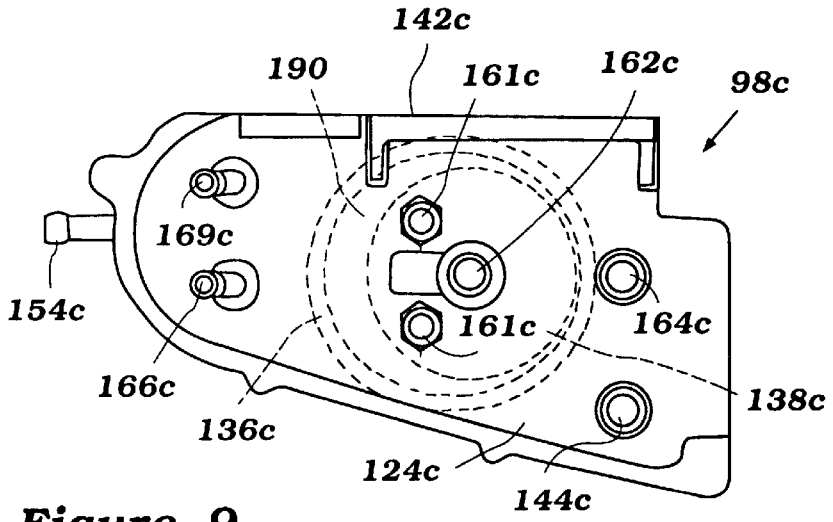
FIG. 9 is a top plan view of the vapor separator of FIG. 8.

FIGS. 8 and 9 illustrate another embodiment of a vapor separator 98*c* in which the high-pressure fuel pump 138*c* is disposed within the bowl 128*c* near the central portion of the internal cavity 130*c*. Again the fuel pump 138*c* is of a roller-vane type configuration with the fuel outlet port 162*c* and terminals 161*c* extend upwardly out of the cover plate 124*c* adjacent to the fuel inlet port 144*c*. The fuel inlet port 144*c* has itself been moved rearwardly to a side-by-side position with the fuel return inlet port 164*c* in order to reduce the length of the vapor separator 98*c*. The vapor vent port 166*c* and oil return port 169*c* are disposed at the forward-most portion of the cover 124*c* as is the vent cavity 168*c*.

As best seen in FIG. 9, the float 136*c* is provided with an opening 190 through which the fuel pump 138*c* extends. With this configuration, the fuel pump 138*c* is positioned within the cavity 130*c*. An O-ring seal 140*c* sealingly engages the upper end of the fuel pump 138*c* and the lower surface of the cover plate 124*c* to prevent fuel and oil from exiting the internal cavity 130*c* past the fuel pump 138*c*.

The strainer 156*c* is positioned at the bottom of the bowl 128*c* generally forwardly of the fuel pump 138*c* with its rearward end lower than its forward end because the lower surface of the bowl 128*c* against which the strainer 156*c* lies extends upwardly in the forward direction. The fuel pump influent port 158*c* extends upwardly from the rear of the strainer 156*c* and sealingly engages the front of the lower end of the high pressure fuel pump 138*c* which is affixed to the lower surface of the bowl 128*c* by the vertically extending bolt 160*c*. The oil inlet port 154*c* is integrally formed within the bottom of the bowl 128*c* to the rear of the strainer 156*c* on the side opposite the fuel pump influent port 158*c*.

As apparent from FIG. 9, the length of the above-described vapor separator 98*c* is greatly reduced because the fuel pump 138*c* extends through the float opening 190 and the fuel inlet port 144*c* has been moved rearwardly.

Figure 10:
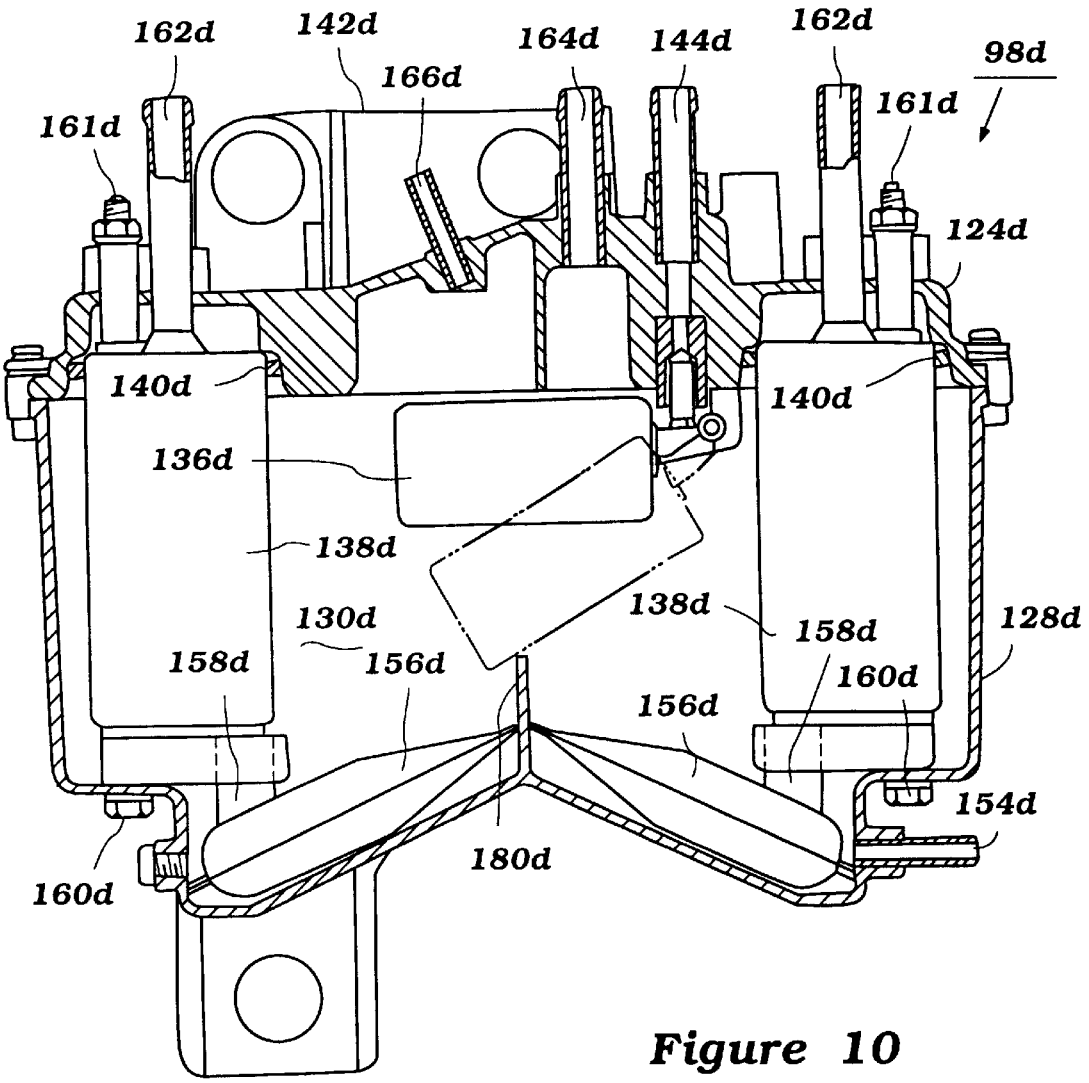
FIG. 10 is a side, cross-sectional view of the vapor separator which is configured in accordance with a further preferred embodiment of the present invention.
Figure 11:
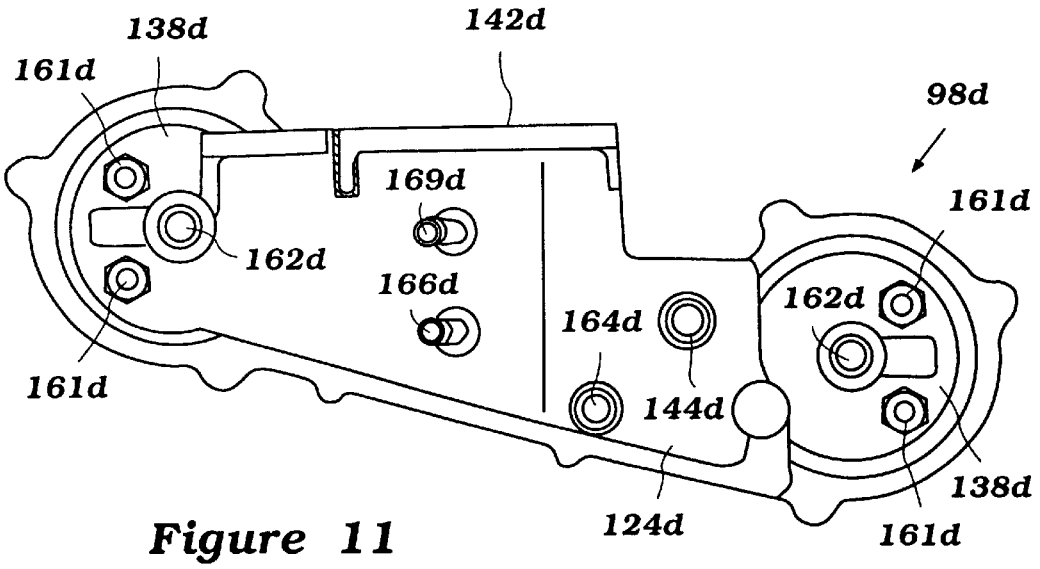
FIG. 11 is a top plan view of the vapor separator of FIG. 10.

FIGS. 10 and 11 illustrate a further compact vapor separator configuration which utilizes two small, centrifugal, rotary-vane type fuel pumps 138*d* (e.g., Wesco-type fuel pumps) . As previously stated, the Wesco-type fuel pump is a rotary-vane type pump which utilizes an impeller as the rotary pumping means. This differs from a roller-vane type pump in that the vanes of a rotary-vane do not contact the inner wall of the pump volute. Pump inefficiencies therefore result. The Wesco-type impeller pump also draws more power from the electrical power source and is therefore less efficient.

The Wesco-type fuel pumps 138*d* shown in FIGS. 10 and 11, however, are smaller than the roller-vane pumps utilized in previous embodiments and draw less power. The pumps are sized so as to together produce a sufficient flow rate and fuel pressure. Two small centrifugal fuel pumps thus can replace one large centrifugal or roller-vane fuel pump. With the Wesco-type fuel pumps, the pumps can be downsized to one-fourth of the size of the convention single Wesco-type fuel pump. As a result, the fuel pump system can be downsized to one-half of the conventional size, thereby reducing the size of the vapor separator assembly. Two small pumps also consume less power than a single large conventional Wesco-type fuel pump.

With reference to FIG. 10, the vapor separator 98*d* is similar to the vapor separator 98*b* of FIGS. 6 and 7 with the fuel pumps 138*d* positioned within the internal cavity 130*d*. Because there are no internal walls the length of the cover 124*d* and bowl 128*d* is reduced and the high pressure fuel pumps 138*d* and strainers 156*d* are brought closer together such that the adjacent ends of the strainers 156*d* are disposed in proximity to or touching the vertical wall 180*d*. The fuel pump influent ports 158*d* extend upwardly from the lower end of the strainers 156*d* to sealingly engage the lower ends of the fuel pumps 138*d* on their inboard sides. The outboard sides of the lower ends of the fuel pumps 138*d* are each affixed to the bottom of the bowl 128*d* by the bolts 160*d*.

Under some circumstances it will be necessary to access the high pressure fuel pump such as when, for example, the pump requires service or repair. It is therefore desirable to have a vapor separator in which the fuel pump is readily accessible. An embodiment of this invention provides a vapor separator assembly which has the fuel pump detachably mounted to an external side of the vapor separator where it is easily accessible for service or repair.

Figure 12:
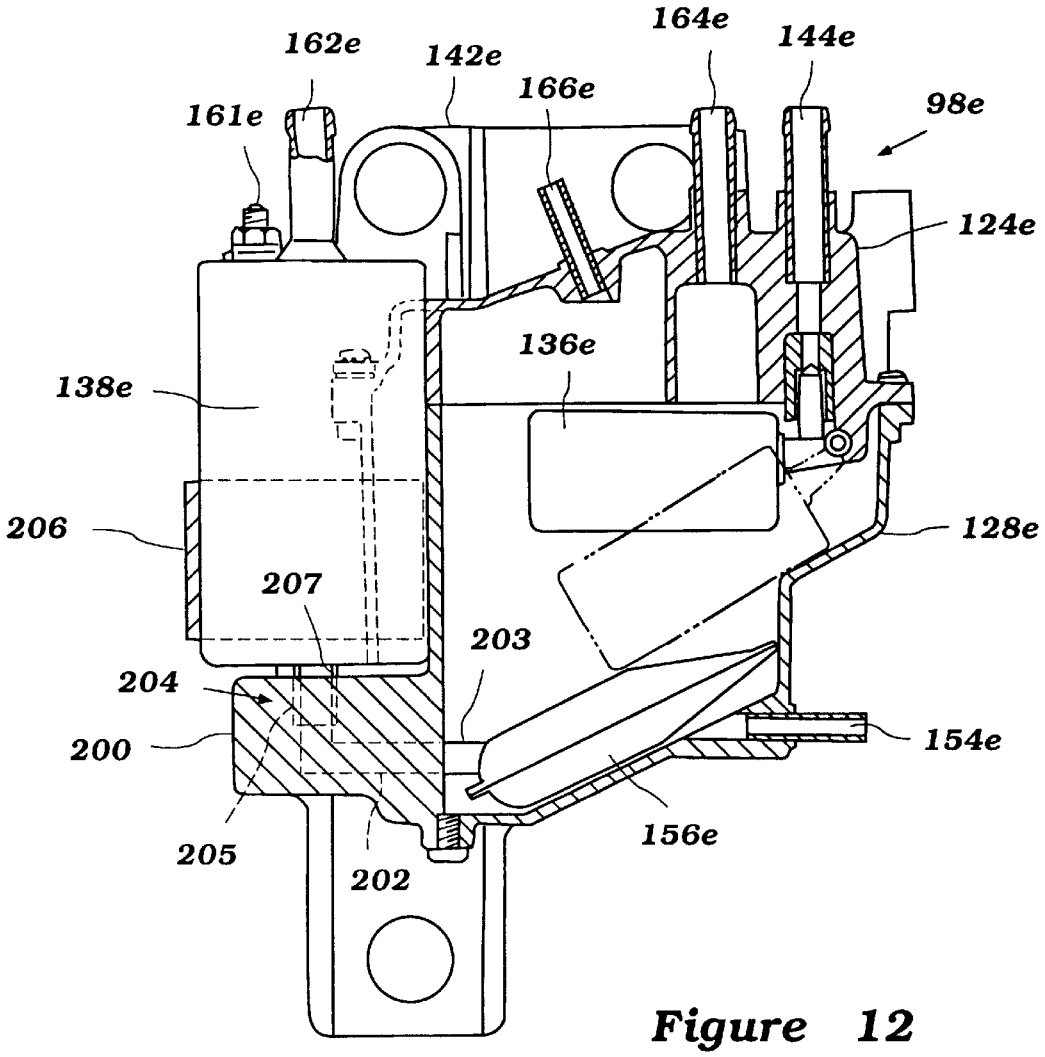
FIG. 12 is a side, cross-sectional view of the vapor separator which is configured in accordance with another preferred embodiment of the present invention.
Figure 13:
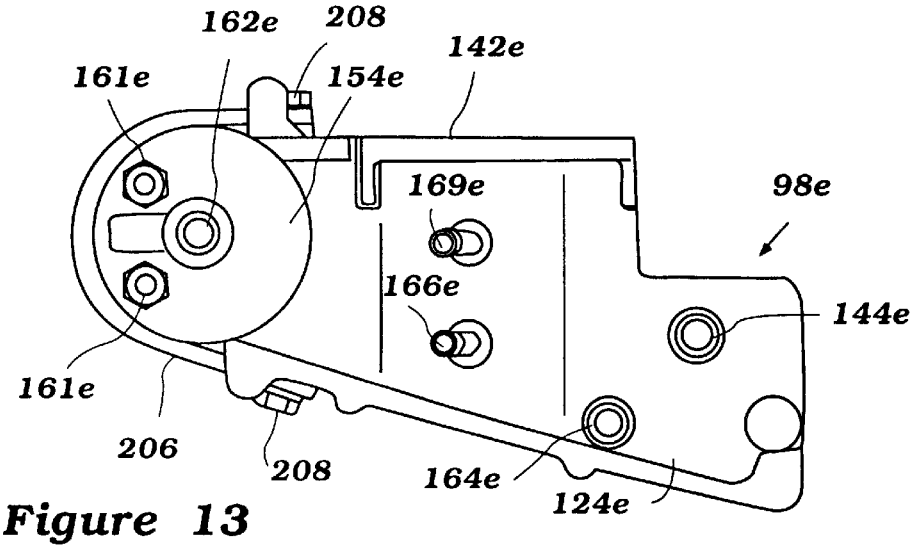
FIG. 13 is a top plan view of the vapor separator of FIG. 12.

FIGS. 12 and 13 illustrate a vapor separator 98*e* that resembles the vapor separator 98 of FIG. 4 but with the high pressure fuel pump 138*e* mounted on the outer peripheral wall of the bowl 128*e*. The bowl 128*e* includes an external boss portion 200 above which is positioned the fuel pump 138*e* and through which extends an effluent conduit 202 that communicates with an outlet end 203 of the strainer 156*e*.

The high pressure fuel pump 138*e* is affixed to the outside of the bowl 128*e* by a releasable coupling assembly 204. In the illustrated embodiment, the releasable coupling includes a receptacle port 205 formed in the boss portion 200 of the housing 128*e*. The receptacle port 205 is sized to receive a port hub 207 formed on a lower end of the fuel pump 138*e*. The port hub 207 frictionally engages the receptacle port 205 to releasably connect the fuel pump 138*e* to the housing 128*e*, as well as to seal the interconnection. In the alternative, the lower end of the fuel pump 138*e* can include a receptacle port with the port hub being formed on boss portion 200. The receptacle port 205 communicates with the conduit 202 formed in the boss portion 200 to place the fuel pump 138*e* in communication with the strainer 156*e*.

A retainer strap 206 bounds the lower perimeter of the fuel pump 138*e* and holds the fuel pump 138*e* in pressing engagement with the front surface of the bowl 124*e*. Openings are provided at the ends of the retainer strap 206 through which screws 208 extend and threadingly engage the bowl 128*e*. At least one end of the retainer strap 206 desirably is easily accessible so as to release the fuel pump 138*e*.

With the above-described vapor separator configuration, the high-pressure fuel pump 138*e* is easily removable by unscrewing the screws 208 and removing at least an end of the retainer strap 206. The fuel pump 138*e* may then be manually separated from its connection to the fuel pump supply conduit 202 and removed from the vapor separator 98*e*.

Figure 14:
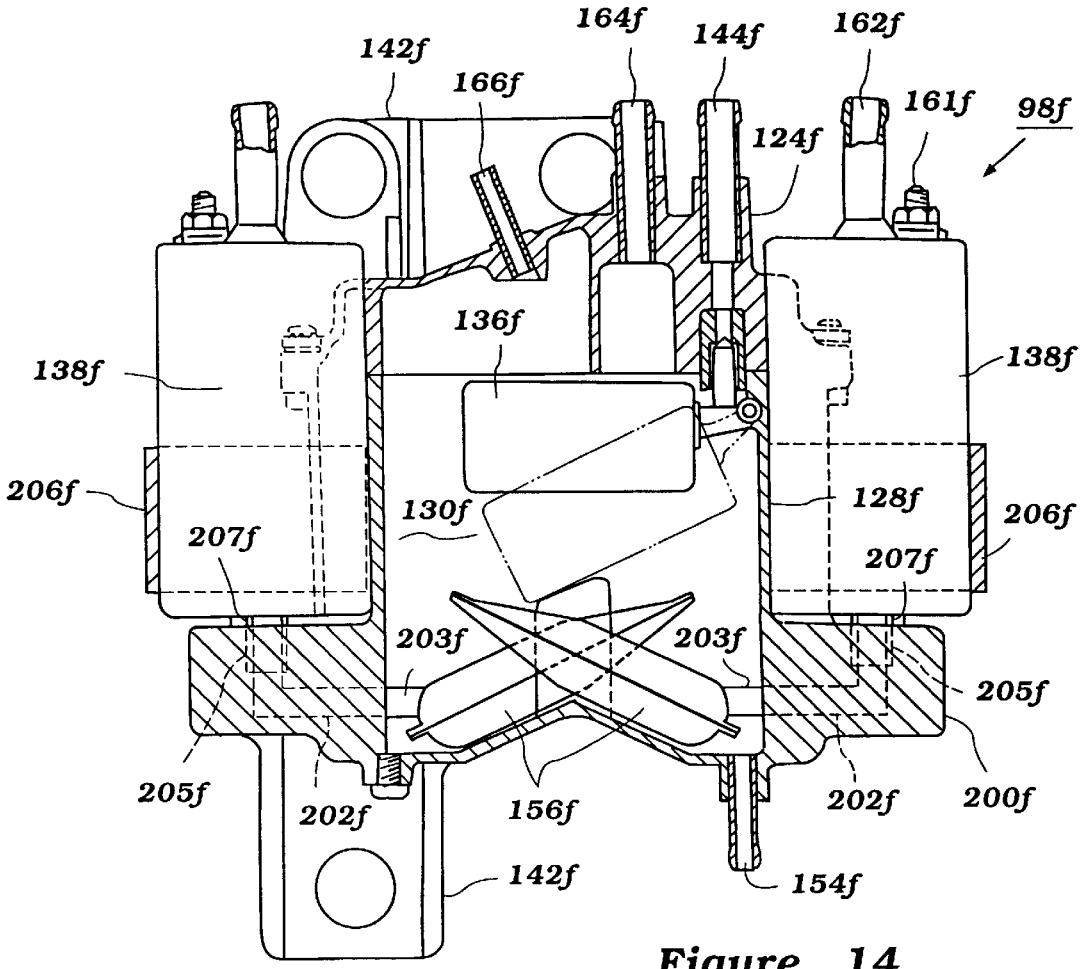
FIG. 14 is a side, cross-sectional view of the vapor separator which is configured in accordance with an additional preferred embodiment of the present invention.
Figure 15:
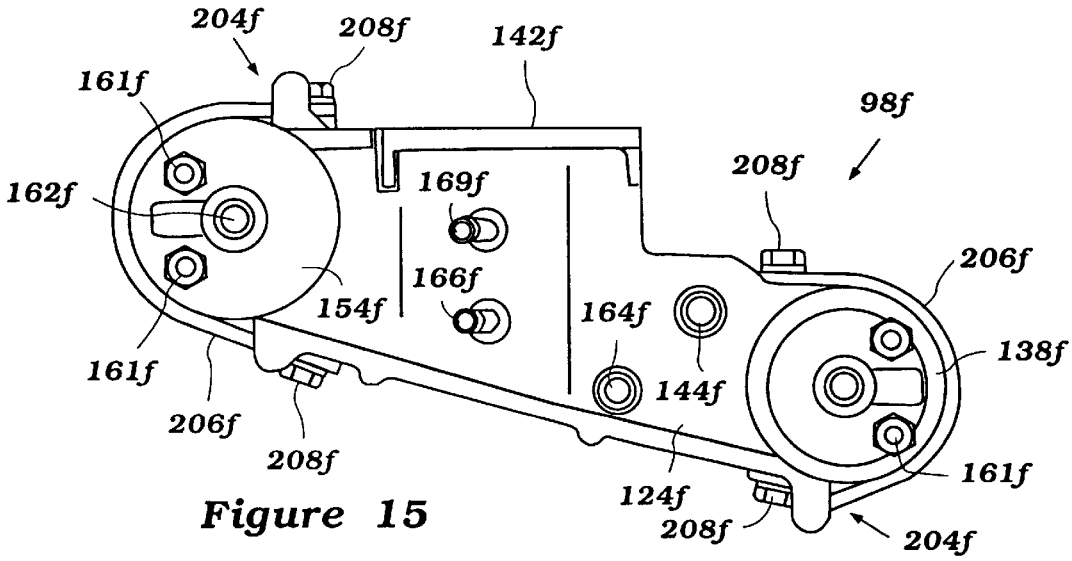
FIG. 15 is a top plan view of the vapor separator of FIG. 14.

FIGS. 14 and 15 illustrate a vapor separator 98*f* that is similar to the vapor separator 98*e* of FIGS. 12 and 13 but which utilizes a second fuel pump 138*f* disposed at the rearward external end of the bowl 128*f* and mounted thereto with a second coupling assembly 204*f*. As mentioned above, it is understood that the above description of the common components will apply equally to this embodiment, unless indicated to the contrary.

A second strainer 156*f* is disposed within the cavity 130*f* and supplies the rearward fuel pump 138*f* with fuel through a further elongated influent port 202*f*. As seen in FIG. 14, the oil inlet port 154*f* is disposed within the bowl 128*f* at the lower rearward portion of the cavity 130*f* adjacent to the second strainer 156*f*. It should also be noted that the strainers 150*f* are disposed in a staggered relationship with each other which allows for a reduction in the length of the vapor separator 98*f* because the strainers 156*f* now overlap.

Figure 16:
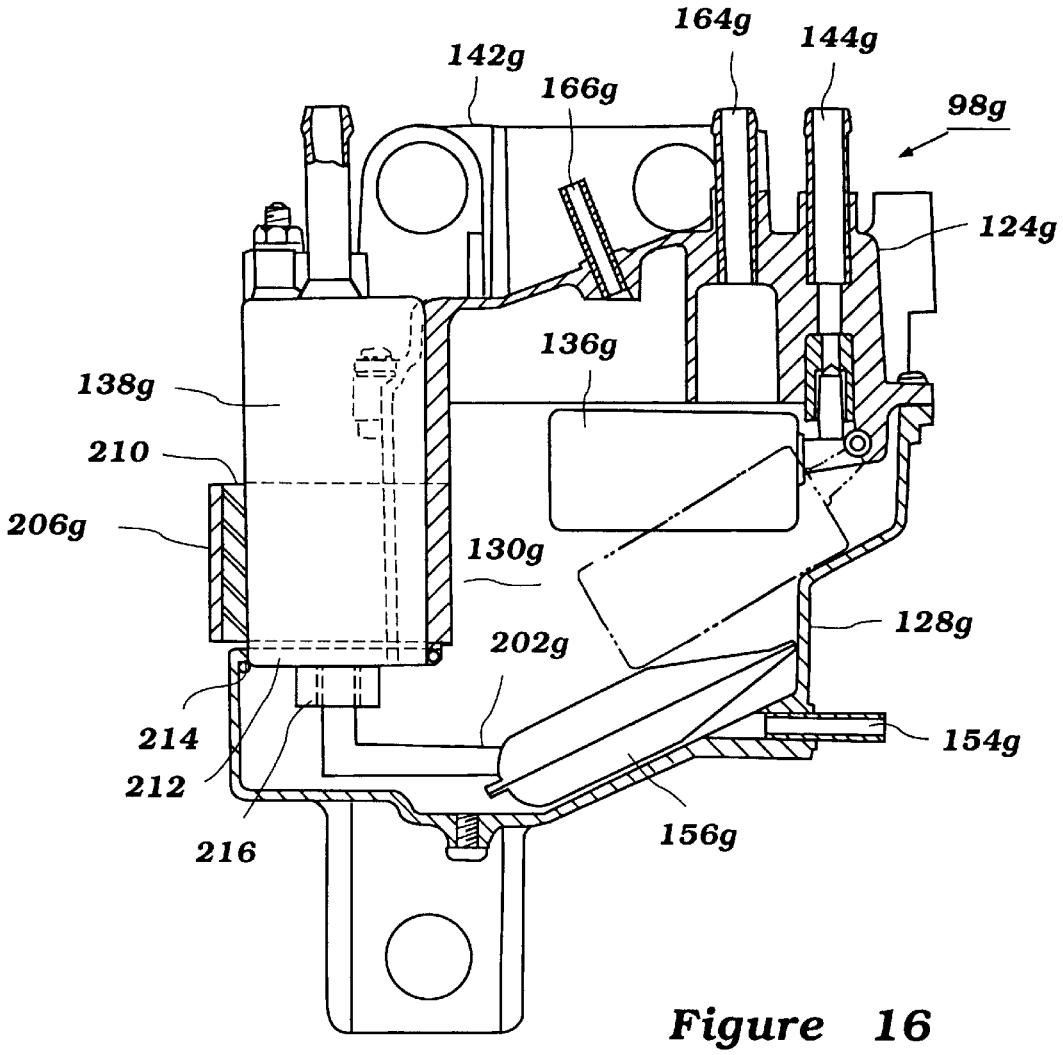
FIG. 16 is a side, cross-sectional view of the vapor separator which is configured in accordance with a further preferred embodiment of the present invention.
Figure 17:
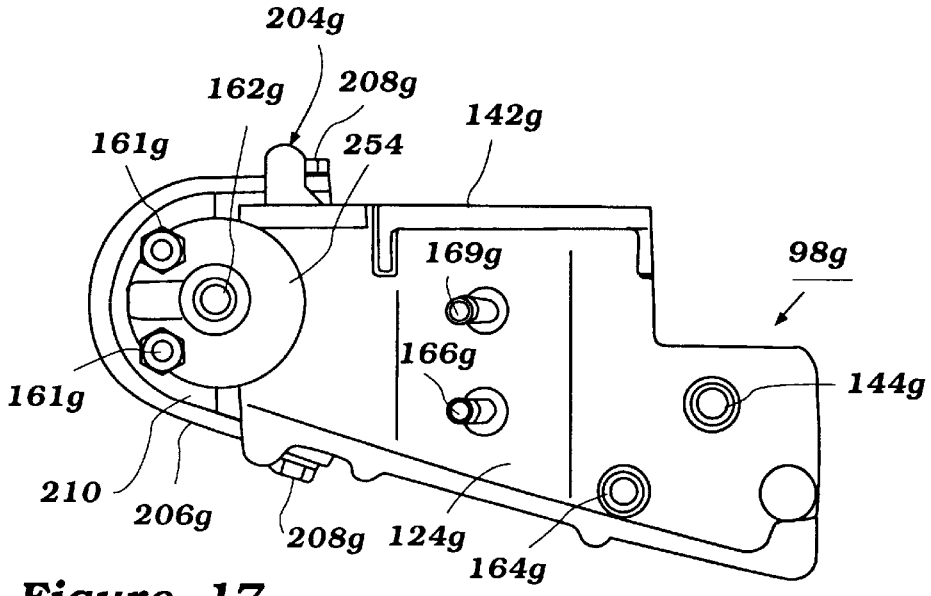
FIG. 17 is a top plan view of the vapor separator of FIG. 16.

FIGS. 16 and 17 illustrate a vapor separator 98*g* similar to the vapor separator 98*e* of FIGS. 12 and 13 but which utilizes a Wesco-type rotary vane, high-pressure fuel pump 138*g*. A port hub or spacer 210 is interposed between the retainer 206*g* and the fuel pump 138*g* so as to maintain a pressing engagement between the coupling assembly 204*g* and the fuel pump 138*g*.

The lower end of the fuel pump 138*g* extends into the internal cavity 130*g* through an opening 212 formed in the front of the bowl 128*g*. An O-ring seal 214 sealingly engages the lower end of the fuel pump 138*g* and is pressed against the walls of the opening 212 and thus prevents any leaking of fuel and oil past the fuel pump 138*g*.

The fuel pump 138*g* is provided with a lower external portion 216 along its lower surface that is sealingly engaged by the fuel pump influent port 202*g* for supplying fuel to the fuel pump 138*g*.

With the above configuration, the fuel pump 138*g* is easily removed from the vapor separator 98*g* by unscrewing the screws 208*g* and removing the retainer strap 206*g* and spacer 210. The Wesco-type fuel pump 138*g* may then be manually separated from the conduit 202*g* and seal 214 and removed from the vapor separator 98*g*. Care should be taken, however, when replacing the fuel pump 138*g* to ensure a sealing contact between the fuel pump 138*g* and the seal 214.

Figure 18:
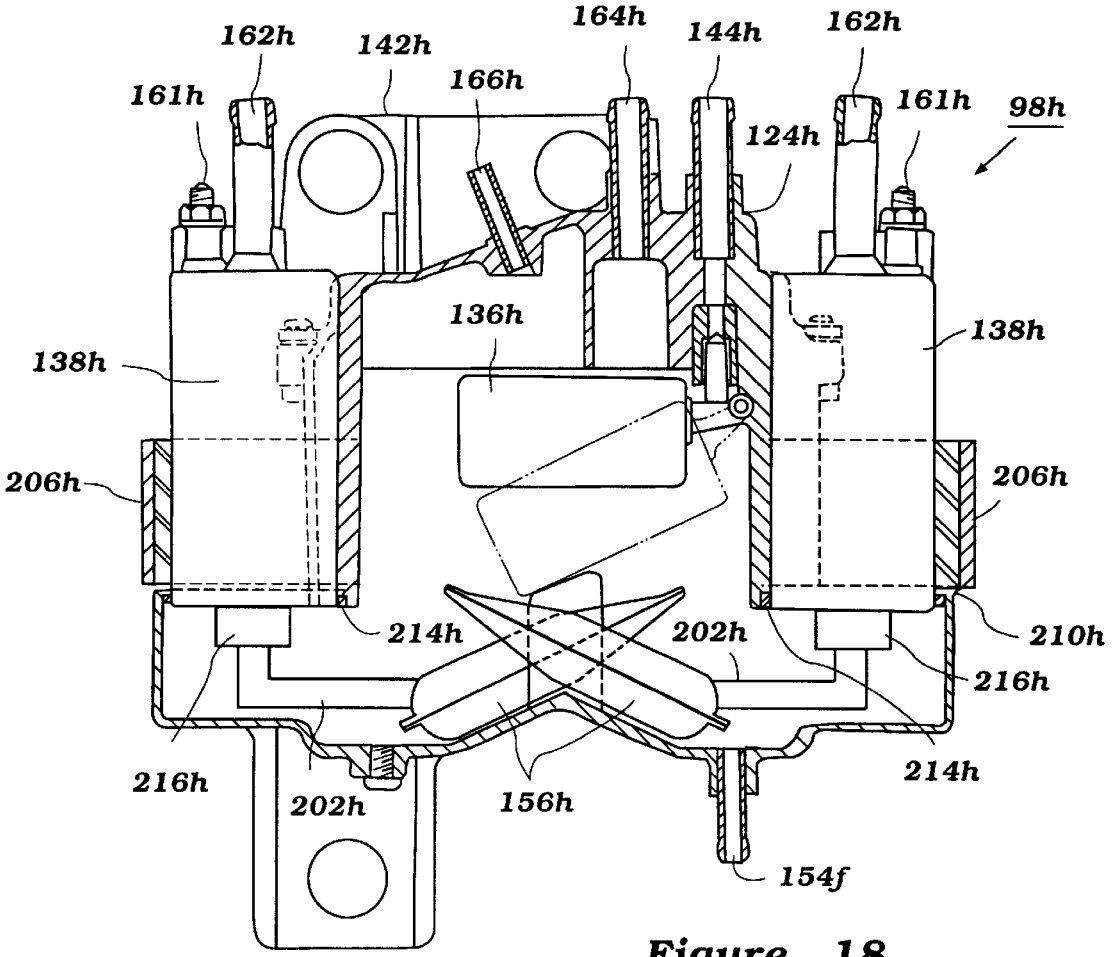
FIG. 18 is a side, cross-sectional view of the vapor separator which is configured in accordance with another preferred embodiment of the present invention.
Figure 19:
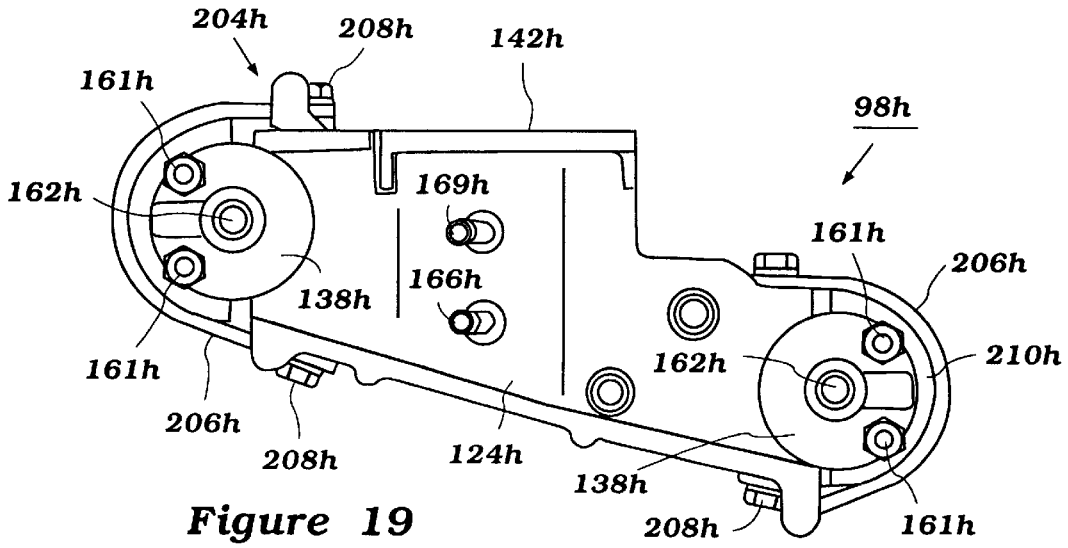
FIG. 19 is a top plan view of the vapor separator of FIG. 18.

FIGS. 18 and 19 illustrate a vapor separator assembly 98*h* similar to the vapor separator 98*g* but which utilizes a second Wesco-type fuel pump 138*h* mounted in like manner to the first fuel pump 138*h*. The vapor separator 98*h* also utilizes two strainers 156*h* in staggered relationship to each other like the vapor separator 98*f* of FIGS. 14 and 15 so as to reduce the overall length of the vapor separator 98*h*. Also the oil inlet port 154*h* is disposed in the lower surface of the bowl 128*h* adjacent to the second strainer 156*h*.

Because the Wesco-type fuel pumps 138*h* are smaller the above configuration provides for a vapor separator 98*h* of minimum size. Additionally, the above configuration has greater recirculation capability than a vapor separator that uses a single roller-vane type fuel pump while requiring less power from the electrical power source.

In the embodiments thus far described both the fuel and the oil are delivered to a single fuel tank; namely the vapor separator internal cavity. It is also possible, however, to deliver the fuel and oil to separate chambers. An embodiment of this invention provides an arrangement in which the oil is delivered to a second fuel tank where it is mixed with the fuel from the first fuel tank and filtered before being delivered to the fuel rail. The two tank arrangement permits the fuel pump to be removed without disturbing the first fuel tank.

Figure 20:
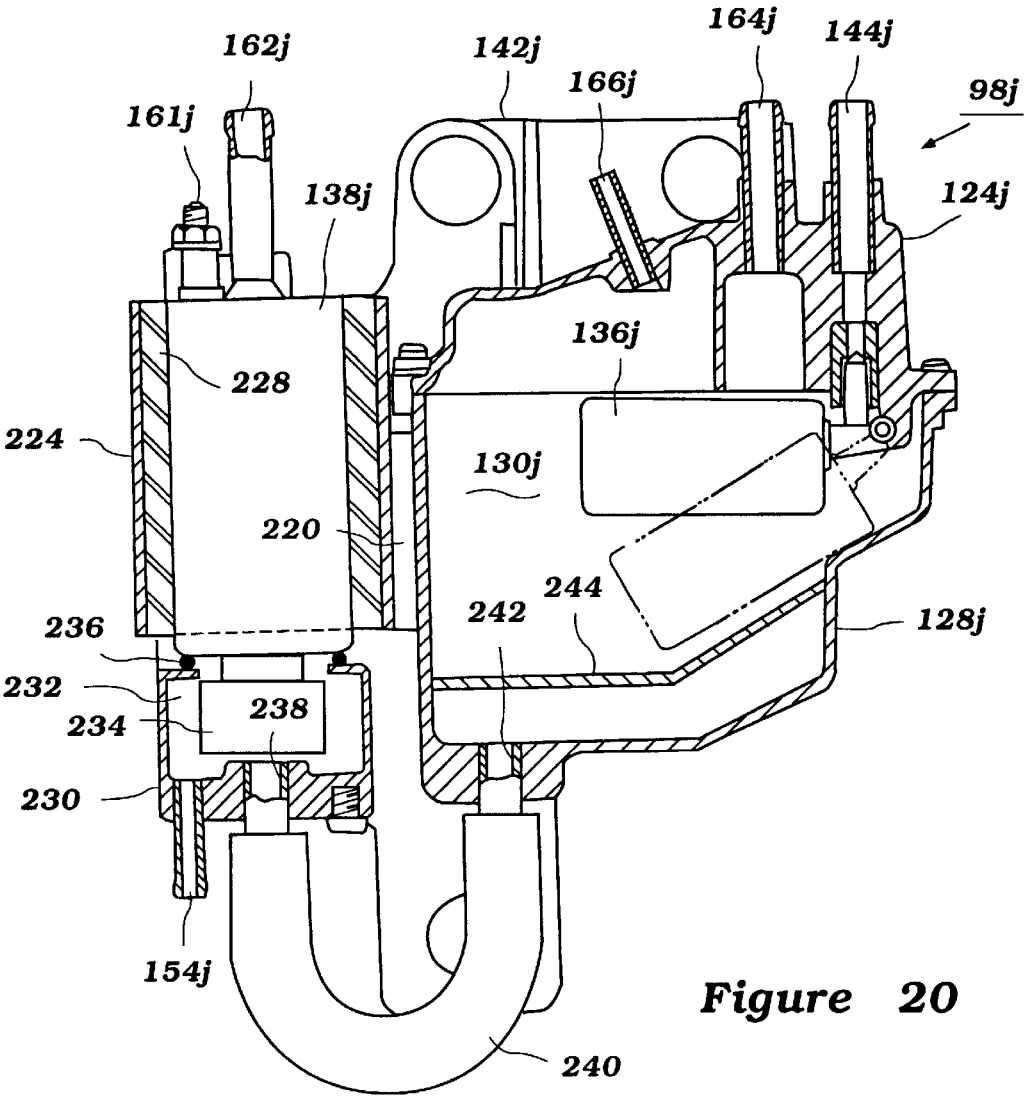
FIG. 20 is a side, cross-sectional view of the vapor separator which is configured in accordance with an additional preferred embodiment of the present invention.
Figure 21:
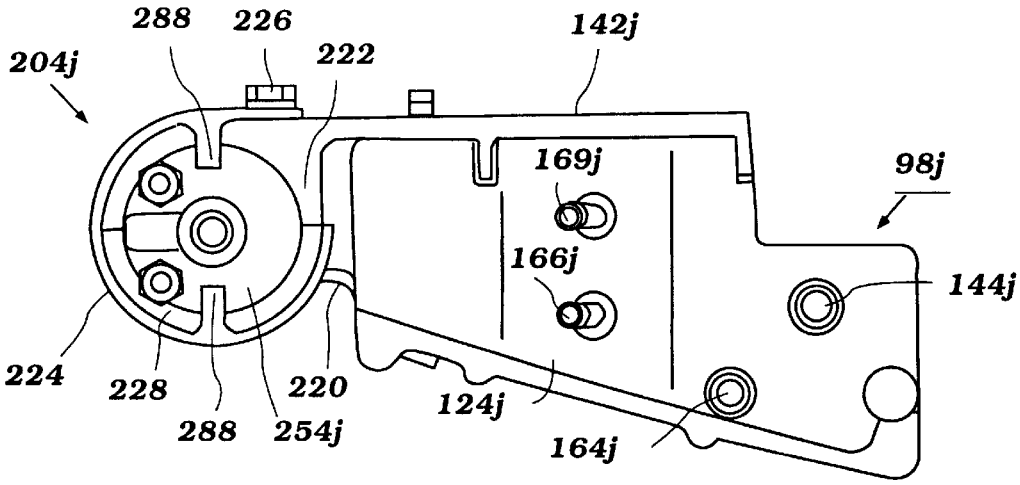
FIG. 21 is a top plan view of the vapor separator of FIG. 20.

FIGS. 20 and 21 illustrate a vapor separator 98*j* in which the Wesco-type fuel pump 138*j* is housed within the mounting plate 142*j* in front of the bowl 128*j* and connected thereto by a gusset 220. The mounting bracket 102*j* includes a concave arm portion 222 that receives the fuel pump 138*j* and to which a modified retainer 224 is affixed by means of the screw 226. A semicircular spacer 228 is interposed between the retainer 224 and the fuel pump 138*j* to hold the fuel pump 138*j* securely within the retainer 224 and arm portion 222 of the vapor separator mounting plate 142*j*.

The retainer 224 is provided with a pair of pressing members 228 along its upper surface which face each other and pressingly engage the upper surface of the fuel pump 138*j* and thus preclude motion of the fuel pump 138*j* along its vertical axis.

A second fuel tank or oil chamber is indicated generally by the reference numeral 230 and affixed to the lower portion of the mounting plate 142*j* immediately below the fuel pump 138*j* by any suitable means. The oil chamber 230 defines a cavity 232 which receives a supply of oil through the oil inlet port 154*j* which is formed integrally within the lower rear surface of the oil chamber 230.

An oil filter 234 engages the lower surface of the fuel pump 138*j* and extends through an opening in the oil chamber 230 into the cavity 232. An O-ring seal 236 is interposed between the lower surface of the fuel pump 138*j* and the upper surface of the oil chamber 230 so as to form a leak-proof barrier between the chamber 230 and fuel pump 138*j*.

A fuel influent port 238 is integrally formed within the oil chamber 230 adjacent to the oil inlet port 148*j* and opens to the cavity 232. The lower end of the port 238*j* is sealingly engaged by one end of a filtered fuel supply conduit 240. The second tank 230 can be easily disconnected from the first tank 130*j* by removing the end of the conduit 240 from the port 238*j* of the second tank 230.

The other end of the conduit 240 sealingly engages a fuel outlet port 242 that is integrally formed within the lower surface of the vapor separator bowl 128*j*. A fuel filtering element is indicated by the reference numeral 244 and extends completely across the lower portion of the bowl 128*j* above the port 242.

Thus, the fuel in the cavity 130*j* is filtered by the fuel filtering element 244 and delivered through the conduit 240 to the oil chamber cavity 232 where it mixes with the oil delivered to the cavity 232 through the oil inlet port 154*j*. The fuel and oil are drawn through the oil filter 234 where any impurities in the oil are filtered before being pumped by the fuel pump 138*j* to the fuel rail 104.

Figure 22:
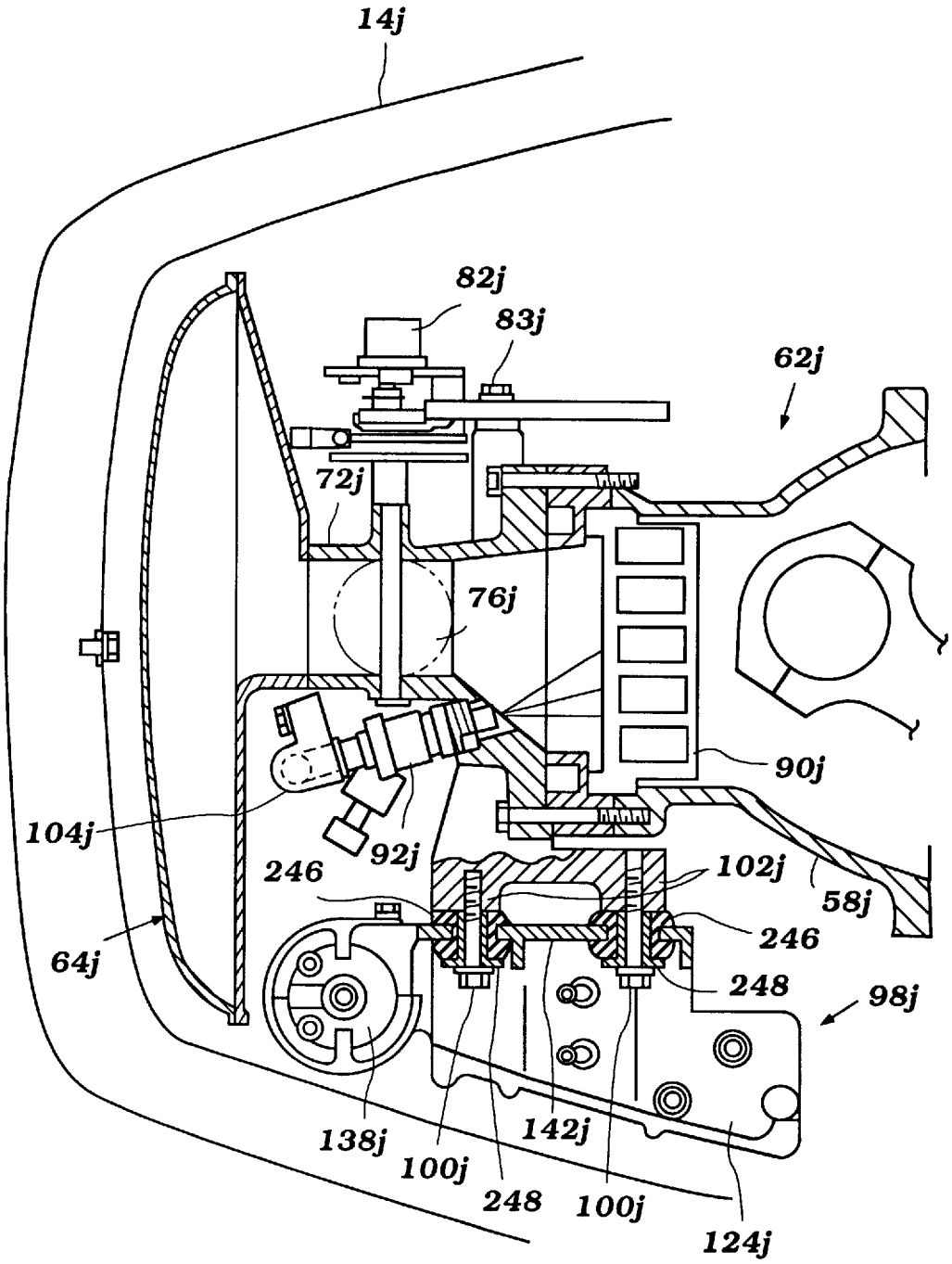
FIG. 22 is a partial top, cross-sectional view of an engine to which the vapor separator of FIGS. 20 and 21 is attached.

FIG. 22 shows in detail the manner by which the vapor separator 98*j* is affixed to the mounting bracket 102*j*. A pair of rubber grommets are indicated generally by the reference numeral 246 and extend through openings in the mounting plate 142*j*. Washer-type guides 248 are disposed within each of the grommets 246 through which the mounting bolts 100*j* extend to threadingly engage the mounting bracket 102*j*. Thus, with the above mounting system the vapor separator 98*j* is securely affixed to the engine 12 while the grommets 246 dampen any vibrations from the engine 12 to the vapor separator 98*j* and thus minimize the possibility of the fuel and oil foaming within the vapor separator 98*j*.

Figure 23:
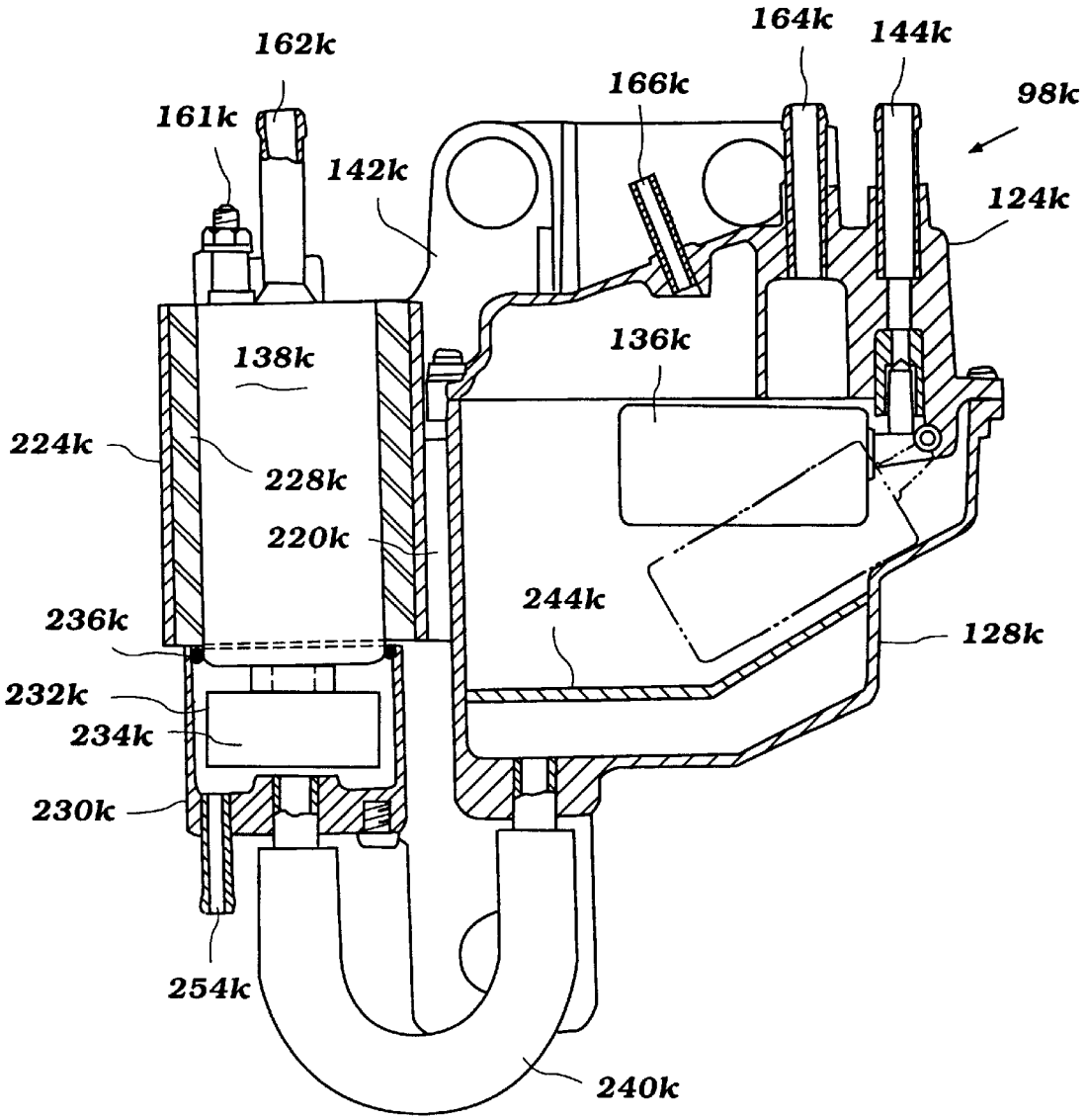
FIG. 23 is a side, cross-sectional view of the vapor separator which is configured in accordance with another preferred embodiment of the present invention.

FIG. 23 illustrates a further vapor separator configuration that is indicated by the reference numeral 98*k* and is identical to the vapor separator 98*j* of FIGS. 20–22 except for the junction between the Wesco-type fuel pump 138*k* and the oil chamber 230*k*. In this embodiment, the bottom of the fuel pump 138*k* extends into the cavity 232*k* through the open upper end of the oil chamber 230*k*. The seal 236*k* is disposed from the oil chamber 230*k* and pressingly engages the lower end of the fuel pump 138*k* and prevents fuel and oil from leaking past the fuel pump 138*k*.

Figure 24:
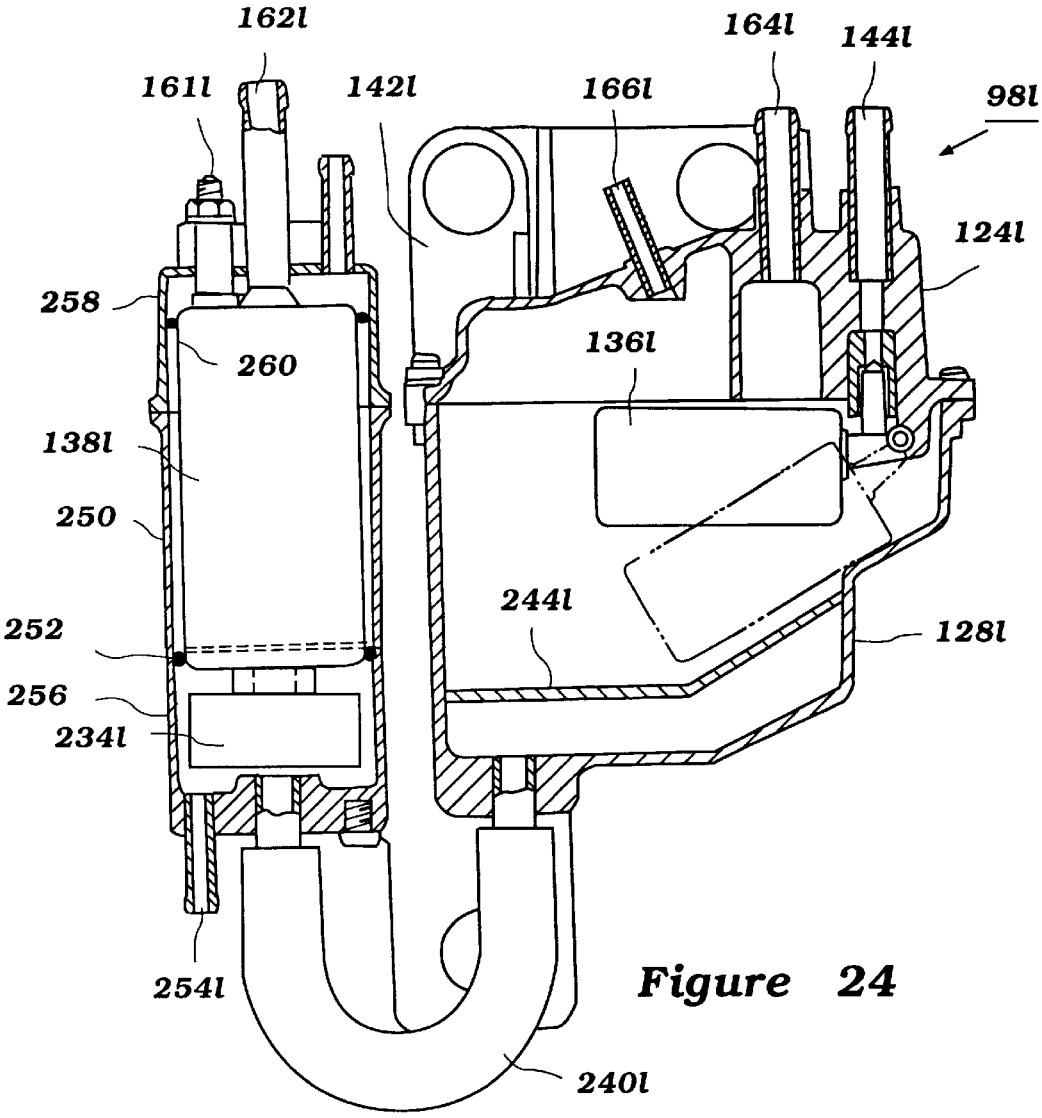
FIG. 24 is a side, cross-sectional view of the vapor separator which is configured in accordance with a further preferred embodiment of the present invention.
Figure 25:
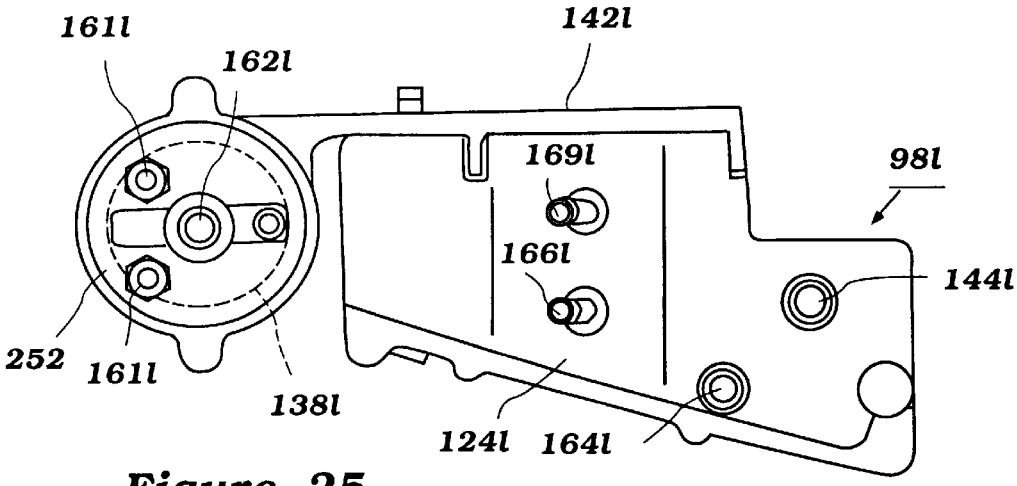
FIG. 25 is a top plan view of the vapor separator of FIG. 24.

FIGS. 24 and 25 illustrate a further vapor separator configuration that is similar to the configurations illustrated in FIGS. 20–22 and FIG. 23 except that the manner by which the fuel pump 138*l* is affixed to the vapor separator 98*l* has been modified. In this embodiment, a fuel pump housing is indicated by the reference numeral 250 and formed integrally with the mounting plate 142*l*. An O-ring seal 252 is disposed within the lower portion of the housing 250 and pressingly engages the lower end of the fuel pump 138*l* above the oil filter 234*l* and thus seals the lower portion of the housing 250 which serves as the oil chamber 256 for the vapor separator 98*l* in which is disposed the oil filter 234*l*.

A cover is indicated by the reference numeral 258 and affixed to the open upper end of the fuel pump housing 250 by any suitable means. The cover 258 has openings formed along its upper surface through which the terminals 161*l* and the fuel outlet fitting 162*l* of the fuel pump 138*l* extends. An O-ring seal 260 is interposed between the cover 258 and upper end the fuel pump 138*l* and constrains the upper end of the fuel pump 138*l* within the cover 258.

From the foregoing, it should be readily apparent that the above-described vapor separators, respectively offer distinct advantages over prior art type of vapor separators. It provides a compact vapor separator with an improved sealing arrangement. And in some embodiment, the fuel pump can be easily removed for repair or service.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A vapor separator assembly for a fuel delivery system used with an internal combustion engine, said vapor separator assembly comprising a housing defining an internal fuel tank which is enclosed within said housing, and a plurality of fuel pumps supported within said housing, each of said fuel pumps communicating with said fuel tank and with a return inlet port which flows into said fuel tank.

2. A vapor separator assembly as in claim 1, wherein an influent port of each fuel pump communicates with a fuel strainer.

3. A vapor separator assembly as in claim 2, wherein said fuel strainers are located within said fuel tank.

4. A vapor separator assembly as in claim 1, wherein said pumps are centrifugal, rotary vane type pumps.

5. A vapor separator assembly as in claim 4, wherein outlets of said pump communicate with a common conduit leading to a fuel rail of the fuel delivery system.

6. A vapor separator assembly as in claim 5, wherein said fuel pumps are selected such that a combined output from said fuel pumps produces a predetermined flow rate through and fuel pressure in the fuel rail, while consuming less power than a single centrifugal, rotary-vane type pump of a size required to produce the same flow rate and fuel pressure.

7. A vapor separator assembly as in claim 6, wherein said fuel pumps are each of a physical size smaller than the size of said single centrifugal, rotary-vane type pump.

8. A vapor separator assembly as in claim 1, wherein at least one of said pumps is a roller-vane type pump.

9. A vapor separator assembly as in claim 8, wherein said housing comprises at least one dividing wall which extends at least for a distance between at least one of said fuel pumps and said fuel tank.

10. A vapor separator assembly as in claim 9, wherein said dividing wall is placed between said fuel pump and a fuel supply inlet which communicates with said fuel tank.

11. A vapor separator assembly as in claim 8 additionally comprising a first seal positioned between a lower end of one of said fuel pumps and said housing, and a second seal positioned between an upper end of said one of said fuel pumps and said housing.

12. A vapor separator assembly as in claim 1, wherein said pumps are releasably attached to said housing.

13. A vapor separator assembly as in claim 12, wherein at least an upper end of said pumps are exposed on the exterior of said housing.

14. A vapor separator assembly for a fuel delivery system used with an internal combustion engine of an outboard drive, said vapor separator assembly comprising a housing defining an internal fuel tank which is enclosed within said housing, and a fuel pump being supported in a generally sealed and enclosed space within said housing, said fuel pump being a roller-vane type fuel pump.

15. A vapor separator assembly for a fuel delivery system used with an internal combustion engine, said vapor assembly comprising a housing defining an internal fuel tank which is enclosed within the housing, a fuel pump being supported with said housing, and a first seal positioned between a lower end of said fuel pump and said housing to generally isolate an upper portion of said fuel pump from fuel within said fuel tank.

16. A vapor separator assembly as in claim 15 additionally comprising another seal being positioned between an upper end of said fuel pump and said housing.

17. A vapor separator assembly as in claim 15, wherein said housing comprises a dividing wall which extends at least for a distance between said fuel pump and said fuel tank.

18. A vapor separator assembly as in claim 17, wherein said dividing wall is placed between said fuel pump and a fuel supply inlet which communicates with said fuel tank.

19. A vapor separator assembly as in claim 18, wherein said dividing wall and said housing together define a cylindrical cavity adjacent to but separated from the fuel tank, said cylindrical cavity being sized to receive a portion of said fuel pump.

20. A vapor separator assembly as in claim 19, wherein said first seal is an O-ring compressed between a wall of the cylindrical cavity and the fuel pump at a lower end of said cavity.

21. A vapor separator assembly for a fuel delivery system used with an internal combustion engine, said vapor separator assembly comprising a housing defining an internal fuel tank which is enclosed within said housing, at least one fuel pump being supported by said housing with at least a portion of said pump being exposed outside said housing, and a releasable coupling interconnecting said pump and said housing to place said pump in communication with said fuel tank, said coupling being configured and arranged on the housing so that the fuel pump can be disconnected from the housing without opening the fuel tank.

22. A vapor separator assembly as in claim 21, wherein said fuel pump is located on outer peripheral wall of said housing.

23. A vapor separator assembly as in claim 21, wherein said releasable coupling comprising a receptacle port which receives a port hub in a friction-fit manner.

24. A vapor separator assembly as in claim 23, wherein said receptacle port is formed on said housing and communicates with said fuel tank.

25. A vapor separator assembly as in claim 21, wherein a strap secures said pump to said housing.

26. A vapor separator assembly for a fuel delivery system used with an internal combustion engine, said vapor separator assembly comprising a housing defining an internal fuel tank which is located within said housing, at least one fuel pump being supported by said housing with a portion of said fuel pump being exposed outside said housing, and a releasable coupling interconnecting said pump and said housing to place said pump in communication with said fuel tank, said releasable coupling comprising an aperture in said housing sized to receive a lower end of said fuel pump with a seal compressed between a wall of said housing and a lower end of said pump.

27. A vapor separator assembly as in claim 26, wherein said seal is compressed between an inner wall of said aperture and an exterior arcuate surface of a cylindrical casing of said pump.

28. A vapor separator assembly as in claim 26, wherein said wall of said housing circumscribes said aperture and said seal is compressed between said wall and a flat end face of said pump.

29. A vapor separator assembly as in claim 26, wherein a strap secures said pump to said housing.

30. A vapor separator assembly as in claim 26 additionally comprising another pump which is removably connected to said housing by another releasable coupling.

31. A vapor separator assembly as in claim 30, wherein said pumps are centrifugal, rotary-vane type pumps.

32. A vapor separator assembly for a fuel delivery system used with an internal combustion engine, said vapor separator assembly comprising first and second separate fuel tanks which communicate with one another through a conduit, said conduit connected with said first fuel tank through a port formed in a wall of the first fuel tank, said wall being uncommon to said second fuel tank, a fuel inlet communicating with said first fuel tank, and at least one fuel pump communicating with said second fuel tank.

33. A vapor separator assembly as in claim 32 additionally comprising a releasable coupling interconnecting said fuel pump to said second fuel tank.

34. A vapor separator assembly as in claim 33, wherein said releasable coupling comprising an aperture in said housing sized to receive a lower end of said fuel pump with a seal compressed between a wall of said housing and a lower end of said pump.

35. A vapor separator assembly as in claim 34, wherein said seal is compressed between an inner wall of said aperture and an exterior arcuate surface of a cylindrical casing of said pump.

36. A vapor separator assembly as in claim 34, wherein said wall of said housing circumscribes said aperture and said seal is compressed between said wall and a flat end face of said pump.

37. A vapor separator assembly as in claim 33, wherein said first fuel tank is enclosed within a first housing with said second fuel tank disposed apart from said housing.

38. A vapor separator assembly as in claim 37, wherein a bracket supports said housing and said second fuel tank.

39. A vapor separator assembly as in claim 38, wherein said bracket is intended to be connected to the engine near an end of a crankcase member opposite of a cylinder block of the engine.

40. A vapor separator assembly as in claim 32 additionally comprising a first seal positioned between a lower end of said fuel pump and an inner wall of said second fuel tank, and a second seal positioned between an upper end of said fuel pump and said inner wall of said second fuel tank.

41. A vapor separator assembly as in claim 32, wherein said second fuel tank comprises an oil inlet port through which oil is introduced into the fuel upstream of the fuel pump.

42. A vapor separator assembly as in claim 32 additionally comprising a filter positioned within said first fuel tank.

43. A vapor separator assembly as in claim 32, wherein said second fuel tank is releasably attached to said first fuel tank.

44. A vapor separator assembly as in claim 14, wherein said enclosed space is arranged within the housing to be in fluidic communication with the fuel tank.

45. A vapor separator assembly as in claim 44 additionally comprising a seal positioned between a lower end of the fuel pump and the housing to generally isolate the fuel pump from the fuel within the housing.

46. A vapor separator assembly as in claim 15, wherein the fuel pump is a positive displacement type pump.

* * * * *